US012410802B2

(12) United States Patent
Shibata et al.

(10) Patent No.: US 12,410,802 B2
(45) Date of Patent: Sep. 9, 2025

(54) MULTI-STAGE ELECTRIC CENTRIFUGAL COMPRESSOR

(71) Applicant: MITSUBISHI HEAVY INDUSTRIES ENGINE & TURBOCHARGER, LTD., Sagamihara (JP)

(72) Inventors: Naomichi Shibata, Sagamihara (JP); Byeongil An, Sagamihara (JP); Takaaki Yoshizawa, Sagamihara (JP)

(73) Assignee: MITSUBISHI HEAVY INDUSTRIES ENGINE & TURBOCHARGER, LTD., Sagamihara (JP)

( * ) Notice: Subject to any disclaimer, the term of this patent is extended or adjusted under 35 U.S.C. 154(b) by 204 days.

(21) Appl. No.: 18/001,666

(22) PCT Filed: Jul. 15, 2020

(86) PCT No.: PCT/JP2020/027555
§ 371 (c)(1),
(2) Date: Dec. 13, 2022

(87) PCT Pub. No.: WO2022/013985
PCT Pub. Date: Jan. 20, 2022

(65) Prior Publication Data

US 2023/0332607 A1 Oct. 19, 2023

(51) Int. Cl.
*F04D 25/06* (2006.01)
*F04D 17/12* (2006.01)
(Continued)

(52) U.S. Cl.
CPC ..... *F04D 25/06* (2013.01); *F04D 29/056* (2013.01); *F04D 29/4213* (2013.01);
(Continued)

(58) Field of Classification Search
CPC ..... F04D 25/06; F04D 17/12; F04D 29/056; F04D 29/4206; F04D 29/4213;
(Continued)

(56) References Cited

U.S. PATENT DOCUMENTS 6,155,802 A * 12/2000 Choi ..... F04D 29/057 415/199.1
6,616,421 B2 9/2003 Mruk et al.
(Continued)

FOREIGN PATENT DOCUMENTS

CN 102656380 A 9/2012
CN 110541831 A 12/2019
(Continued)

OTHER PUBLICATIONS

International Preliminary Report on Patentability and English translation of the Written Opinion of the International Searching Authority for International Application No. PCT/JP2020/027555, dated Jan. 26, 2023.
(Continued)

*Primary Examiner* — David N Brandt
(74) *Attorney, Agent, or Firm* — Birch, Stewart, Kolasch & Birch, LLP

(57) ABSTRACT

A multi-stage electric centrifugal compressor configured to drive impellers disposed at both ends of a rotational shaft by an electric motor includes: the rotational shaft; a low-pressure-stage impeller disposed at one end of the rotational shaft; a high-pressure-stage impeller disposed at the other end of the rotational shaft; a high-pressure-stage housing accommodating the high-pressure-stage impeller; and a connecting pipe for supplying a compressed gas compressed by the low-pressure-stage impeller to the high-pressure-stage housing. The high-pressure-stage housing has a high-pressure-stage inlet opening that opens in a direction intersecting
(Continued)

an axis of the rotational shaft. The connecting pipe includes a high-pressure-stage-side connection portion connected to the high-pressure-stage inlet opening.

15 Claims, 13 Drawing Sheets

(51) Int. Cl.
*F04D 29/056* (2006.01)
*F04D 29/42* (2006.01)
*F04D 29/44* (2006.01)
*F04D 29/58* (2006.01)

(52) U.S. Cl.
CPC ..... *F04D 29/5826* (2013.01); *F04D 17/125* (2013.01); *F04D 29/444* (2013.01)

(58) Field of Classification Search
CPC .. F04D 29/5826; F04D 17/122; F04D 17/125; F04D 29/441; F04D 29/444
See application file for complete search history.

(56) References Cited

U.S. PATENT DOCUMENTS

| | | | | |
|---|---|---|---|---|
| 7,753,646 | B1 | 7/2010 | Keck et al. | |
| 2003/0168064 | A1* | 9/2003 | Daly | A61M 16/0816 128/204.18 |
| 2010/0124491 | A1* | 5/2010 | Bosen | F04D 29/051 415/198.1 |
| 2011/0243762 | A1 | 10/2011 | Daikoku et al. | |
| 2012/0257966 | A1 | 10/2012 | Boening et al. | |
| 2015/0233384 | A1 | 8/2015 | Thompson et al. | |
| 2017/0002727 | A1 | 1/2017 | An et al. | |
| 2017/0102008 | A1* | 4/2017 | Oliphant | F04D 25/045 |
| 2017/0254344 | A1* | 9/2017 | Nakaniwa | F01D 25/002 |
| 2019/0048893 | A1* | 2/2019 | Kim | F04D 17/12 |
| 2020/0300197 | A1 | 9/2020 | Duri | |

FOREIGN PATENT DOCUMENTS

| | | | |
|---|---|---|---|
| JP | 52-1554 | A | 1/1977 |
| JP | 51-61019 | A | 5/1978 |
| JP | 60-49291 | U | 4/1985 |
| JP | 3-15696 | A | 1/1991 |
| JP | 3-35297 | U | 4/1991 |
| JP | 11-230098 | A | 8/1999 |
| JP | 2001-123997 | A | 5/2001 |
| JP | 2001-173591 | A | 6/2001 |
| JP | 2001-271797 | A | 10/2001 |
| JP | 2002-64956 | A | 2/2002 |
| JP | 2009-281278 | A | 12/2009 |
| JP | 2011-214523 | A | 10/2011 |
| JP | 2015-155696 | A | 8/2015 |
| JP | 2019-515168 | A | 8/2019 |
| WO | WO 2015/128936 | A1 | 9/2015 |

OTHER PUBLICATIONS

International Search Report for International Application No. PCT/JP2020/027555, dated Sep. 15, 2020.
Office Action issued in Chinese Application No. 202080101863.1 on Dec. 25, 2024.
Office Action issued in German Application No. 11 2020 007 071.9 on Jan. 16, 2025, with English translation.

* cited by examiner

MULTI-STAGE ELECTRIC CENTRIFUGAL COMPRESSOR

TECHNICAL FIELD

The present disclosure relates to a multi-stage electric centrifugal compressor configured to drive impellers disposed at both ends of a rotational shaft by an electric motor.

BACKGROUND

An electric centrifugal compressor may be mounted on a fuel cell vehicle which generates electricity with a fuel cell mounted on the vehicle body and runs on the power of an electric motor. The electric centrifugal compressor supplies compressed air to the fuel cell to improve the efficiency of the fuel cell. Electric centrifugal compressors include multi-stage electric centrifugal compressors which compress the volume of gas (e.g., air) in stages.

The multi-stage electric centrifugal compressor is configured to compress gas to a first pressure by a low-pressure-stage impeller disposed at one end of a rotational shaft rotated by an electric motor, and compress the compressed air compressed by the low-pressure-stage impeller to a second pressure higher than the first pressure by a high-pressure-stage impeller disposed at the other end of the rotational shaft (for example, Patent Document 1).

The multi-stage electric centrifugal compressor described in Patent Document 1 includes a low-pressure-stage housing accommodating the low-pressure-stage impeller and a high-pressure-stage housing accommodating the high-pressure-stage impeller. The high-pressure-stage housing has an inlet opening that opens in the axial direction of the rotational shaft. The compressed air compressed by the low-pressure-stage impeller is introduced into the high-pressure-stage housing through the inlet opening and further compressed by the high-pressure-stage impeller.

CITATION LIST

Patent Literature

Patent Document 1: JP2015-155696A

SUMMARY

Problems to be Solved

In order to meet the required performance (low flow rate and high pressure) of fuel cell vehicles, it is necessary to increase the output of electric motors and the air compression ratio of multi-stage electric centrifugal compressors. In order to increase the output of electric motors and the air compression ratio of multi-stage electric centrifugal compressors, the structure of multi-stage electric centrifugal compressors tends to be complicated, and the size of multi-stage electric centrifugal compressors tends to increase. It is thus necessary to downsize multi-stage electric centrifugal compressors.

In view of the above, an object of at least one embodiment of the present disclosure is to provide a multi-stage electric centrifugal compressor that enables downsizing of the multi-stage electric centrifugal compressor.

Solution to the Problems

A multi-stage centrifugal compressor according to the present disclosure is a multi-stage electric centrifugal compressor configured to drive impellers disposed at both ends of a rotational shaft by an electric motor, comprising: the rotational shaft; a low-pressure-stage impeller disposed at one end of the rotational shaft; a high-pressure-stage impeller disposed at the other end of the rotational shaft; a high-pressure-stage housing accommodating the high-pressure-stage impeller; and a connecting pipe for supplying a compressed gas compressed by the low-pressure-stage impeller to the high-pressure-stage housing. The high-pressure-stage housing has a high-pressure-stage inlet opening that opens in a direction intersecting an axis of the rotational shaft. The connecting pipe includes a high-pressure-stage-side connection portion connected to the high-pressure-stage inlet opening.

Advantageous Effects

At least one embodiment of the present invention provides a multi-stage electric centrifugal compressor that enables downsizing and lightening.

DETAILED DESCRIPTION

Figure 1:
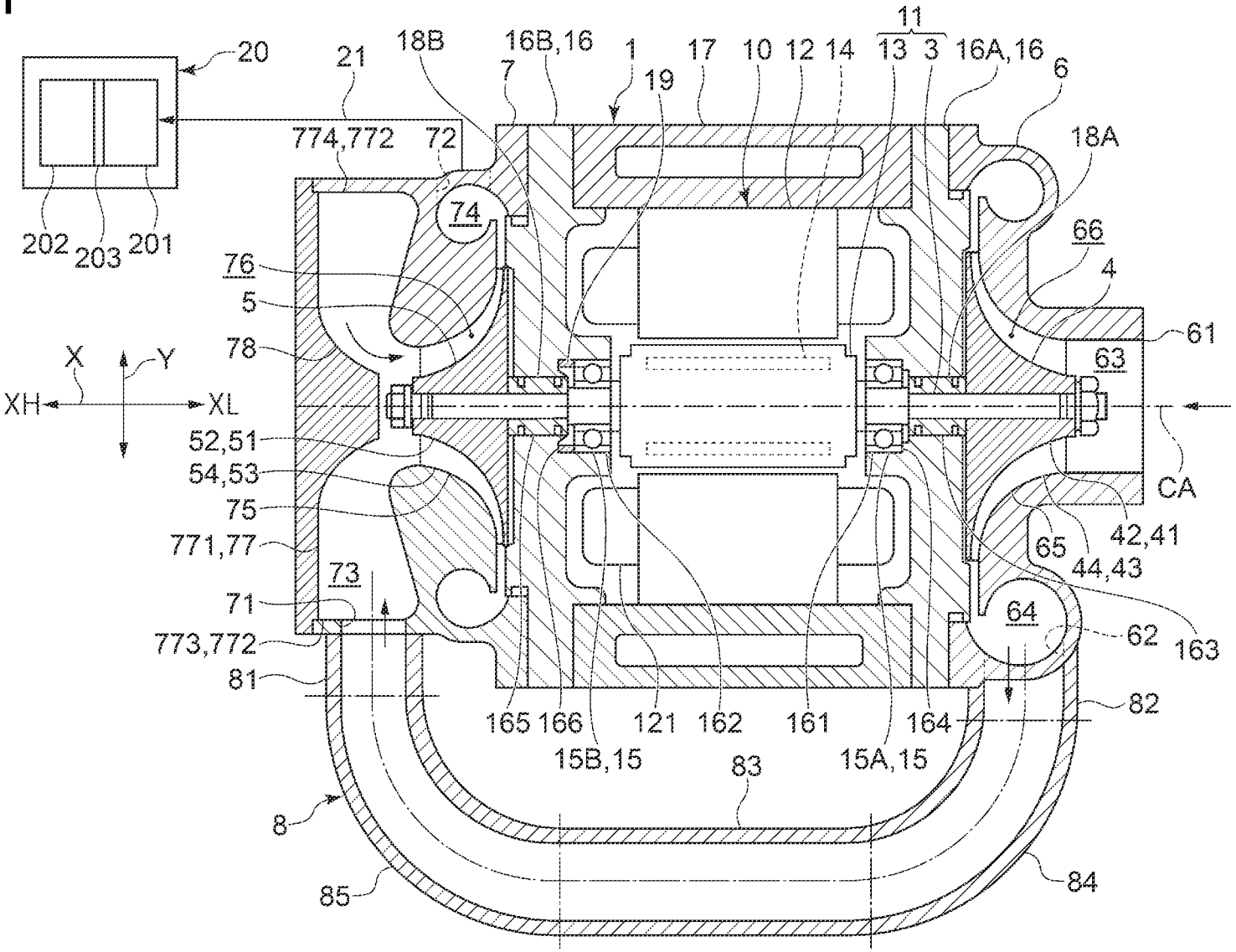
FIG. 1 is a schematic configuration diagram schematically showing a configuration of a multi-stage electric centrifugal compressor according to an embodiment of the present disclosure.

Embodiments of the present disclosure will be described below with reference to the accompanying drawings. It is intended, however, that unless particularly identified, dimensions, materials, shapes, relative positions, and the like of components described in the embodiments shall be interpreted as illustrative only and not intended to limit the scope of the present disclosure.

For instance, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", "have", "contain" and "constitute" are not intended to be exclusive of other components.

The same features can be indicated by the same reference numerals and not described in detail.

(Multi-Stage Electric Centrifugal Compressor)

FIG. 1 is a schematic configuration diagram schematically showing a configuration of a multi-stage electric centrifugal compressor according to an embodiment of the present disclosure. FIG. 1 schematically shows a cross-section of a multi-stage electric centrifugal compressor 1 taken along an axis CA of a rotational shaft 3.

As shown in FIG. 1, the multi-stage electric centrifugal compressor 1 according to some embodiments of the present disclosure is configured to drive impellers (low-pressure-stage impeller 4, high-pressure-stage impeller 5) disposed at both ends of the rotational shaft 3 by an electric motor 10.

As shown in FIG. 1, the multi-stage electric centrifugal compressor 1 includes at least a rotational shaft 3, a low-pressure-stage impeller 4 disposed at one end (on the right side in FIG. 1) of the rotational shaft 3, a high-pressure-stage impeller 5 disposed at the other end (on the left side in FIG. 1) of the rotational shaft 3, a low-pressure-stage housing 6 configured to accommodate the low-pressure-stage impeller 4, a high-pressure-stage housing 7 configured to accommodate the high-pressure-stage impeller 5, and a connecting pipe 8 for supplying a compressed gas compressed by the low-pressure-stage impeller 4 to the high-pressure-stage housing 7.

Hereinafter, as shown in FIG. 1, the extension direction of the axis CA of the rotational shaft 3 will be referred to as the axial direction X, and the direction perpendicular to the axis CA will be referred to as the radial direction Y. In the axial direction X, the side (the right side in FIG. 1) where the low-pressure-stage impeller 4 is positioned with respect to the high-pressure-stage impeller 5 is referred to as the low-pressure stage side XL, and the side (the left side in FIG. 1) opposite to the low-pressure stage side XL is referred to as the high-pressure stage side XH.

(Electric Motor)

The electric motor 10 mounted on the multi-stage electric centrifugal compressor 1 includes a rotating body 11 which is a rotor and a motor stator 12 which is a stator. The rotating body 11 includes at least the rotational shaft 3 and a rotor assembly 13 mounted on the outer periphery of the rotational shaft 3. The rotor assembly 13 includes a permanent magnet 14. The motor stator 12 includes a motor coil (stator coil) 121 and is configured to generate a magnetic field for rotating the rotating body 11 equipped with the permanent magnet 14 by power supplied from a power source (not shown). When the rotating body 11 rotates due to the magnetic field generated by the motor stator 12 (the power generated by the electric motor 10), the impellers (the low-pressure-stage impeller 4 and the high-pressure-stage impeller 5) mounted on the rotational shaft 3 rotate in tandem.

By rotating the low-pressure-stage impeller 4, the multi-stage electric centrifugal compressor 1 compresses a gas introduced into the low-pressure-stage housing 6 to pressurize the gas to a first pressure. The compressed gas pressurized to the first pressure is led into the high-pressure-stage housing 7 through the connecting pipe 8. By rotating the high-pressure-stage impeller 5, the multi-stage electric centrifugal compressor 1 further compresses the compressed gas introduced into the high-pressure-stage housing 7 to pressurize the compressed gas to a second pressure higher than the first pressure.

The multi-stage electric centrifugal compressor 1 further includes the rotor assembly 13 mounted on the rotational shaft 3, the motor stator 12 disposed to surround the outer periphery of the rotor assembly 13, at least one bearing 15 rotatably supporting the rotational shaft 3, at least one bearing housing 16 configured to accommodate the at least one bearing 15, and a stator housing 17 configured to accommodate the electric motor 10 (motor stator 12). The at least one bearing housing 16 and the stator housing 17 are disposed in the axial direction X between the low-pressure-stage housing 6 and the high-pressure-stage housing 7. The stator housing 17 is disposed adjacent to the at least one bearing housing 16 in the axial direction X. The motor stator 12 is disposed inside the stator housing 17 and supported by the stator housing 17.

(Bearing and Bearing Housing)

In the illustrated embodiment, the at least one bearing 15 includes a low-pressure-stage-side bearing 15A disposed between the low-pressure-stage impeller 4 and the rotor assembly 13 in the axial direction X, and a high-pressure-stage-side bearing 15B disposed between the high-pressure-stage impeller 5 and the rotor assembly 13 in the axial direction X. The at least one bearing housing 16 includes a low-pressure-stage-side bearing housing 16A configured to accommodate the low-pressure-stage-side bearing 15A, and a high-pressure-stage-side bearing housing 16B configured to accommodate the high-pressure-stage-side bearing 15B. The low-pressure-stage-side bearing 15A is supported by a bearing support surface 161 formed inside the low-pressure-stage-side bearing housing 16A. The high-pressure-stage-side bearing 15B is supported by a bearing support surface 162 formed inside the high-pressure-stage-side bearing housing 16B.

The low-pressure-stage-side bearing housing 16A is disposed on the high-pressure stage side XH of the low-pressure-stage housing 6 and on the low-pressure stage side XL of the stator housing 17. The low-pressure-stage-side bearing housing 16A is mechanically connected to the low-pressure-stage housing 6 and the stator housing 17, which are disposed adjacent to the low-pressure-stage-side bearing housing 16A in the axial direction X, by fastening members such as fastening bolts. The high-pressure-stage-side bearing housing 16B is disposed on the low-pressure stage side XL of the high-pressure-stage housing 7 and on the high-pressure stage side XH of the stator housing 17. The high-pressure-stage-side bearing housing 16B is mechanically connected to the high-pressure-stage housing 7 and the stator housing 17, which are disposed adjacent to the high-pressure-stage-side bearing housing 16B in the axial direction X, by fastening members such as fastening bolts.

(Sleeve)

In the illustrated embodiment, the multi-stage electric centrifugal compressor 1 further includes a low-pressure-stage-side sleeve 18A mounted on the outer periphery of the rotational shaft 3 between the low-pressure-stage impeller 4 and the low-pressure-stage-side bearing 15A in the axial direction X, a high-pressure-stage-side sleeve 18B mounted on the outer periphery of the rotational shaft 3 between the high-pressure-stage impeller 5 and the high-pressure-stage-side bearing 15B in the axial direction X, and a pressurizing spring 19 that biases the high-pressure-stage-side bearing 15B toward the low-pressure stage side XL. The above-described rotating body 11 further includes the low-pressure-stage-side sleeve 18A and the high-pressure-stage-side sleeve 18B.

The low-pressure-stage-side bearing housing 16A has an inner surface (sleeve-facing surface) 163 that faces the outer peripheral surface of the low-pressure-stage-side sleeve 18A and an engagement surface 164 that extends inward in the radial direction from the end portion of the bearing support surface 161 on the low-pressure stage side XL and engages the low-pressure-stage-side bearing 15A. The inner surface 163 is formed to have a smaller diameter than the bearing support surface 161. The high-pressure-stage-side bearing housing 16B has an inner surface (sleeve-facing surface) 165 that faces the outer peripheral surface of the high-pressure-stage-side sleeve 18B and an engagement surface 166 that extends inward in the radial direction from the end portion of the bearing support surface 162 on the high-pressure stage side XH. The inner surface 165 is formed to have a smaller diameter than the bearing support surface 162. The pressurizing spring 19 is disposed between the engagement surface 166 and the high-pressure-stage-side bearing 15B to apply a predetermined pressure to the high-pressure-stage-side bearing 15B.

(Low-Pressure-Stage Housing and Low-Pressure-Stage Impeller)

As shown in FIG. 1, the low-pressure-stage housing 6 has a low-pressure-stage inlet opening 61 for introducing a gas from the outside to the inside of the low-pressure-stage housing 6, and a low-pressure-stage outlet opening 62 for discharging the gas from the inside to the outside of the low-pressure-stage housing 6. Inside the low-pressure-stage housing 6, a supply passage 63 for guiding the gas introduced into the low-pressure-stage housing 6 from the low-pressure-stage inlet opening 61 to the low-pressure-stage impeller 4, and a scroll passage 64 for guiding the gas that has passed through the low-pressure-stage impeller 4 to the low-pressure-stage outlet opening 62 are formed. In the illustrated embodiment, the low-pressure-stage inlet opening 61 opens toward the low-pressure stage side XL in the axial direction X. The low-pressure-stage outlet opening 62 opens in a direction intersecting (e.g., perpendicular to) the axis CA.

In the embodiment shown in FIG. 1, the low-pressure-stage impeller 4 includes a hub 41 mechanically connected to one side of the rotational shaft 3 and a plurality of impeller blades 43 disposed on an outer peripheral surface 42 of the hub 41. The low-pressure-stage impeller 4 can rotate in conjunction with the rotational shaft 3 about the axis CA of the rotational shaft 3. The low-pressure-stage impeller 4 is composed of a centrifugal impeller configured to guide the gas sent from the low-pressure stage side XL along the axial direction X to the outer side in the radial direction Y. A gap (clearance) is formed between each of the tips 44 of the impeller blades 43 and a convexly curved shroud 65 of the low-pressure-stage housing 6.

In the embodiment shown in FIG. 1, the low-pressure-stage housing 6 is combined with another member (in the illustrated example, low-pressure-stage-side bearing housing 16A) to form a low-pressure-stage impeller chamber 66 rotatably accommodating the low-pressure-stage impeller 4. The low-pressure-stage impeller chamber 66 communicates with the supply passage 63 disposed upstream in the gas flow direction and the scroll passage 64 disposed downstream in the gas flow direction. The scroll passage 64 has a scroll shape surrounding the outer side of the low-pressure-stage impeller 4 in the radial direction Y. The shroud 65 defines a part of the low-pressure-stage impeller chamber 66.

(High-Pressure-Stage Housing and High-Pressure-Stage Impeller)

As shown in FIG. 1, the high-pressure-stage housing 7 has a high-pressure-stage inlet opening 71 for introducing a gas from the outside to the inside of the high-pressure-stage housing 7, and a high-pressure-stage outlet opening 72 for discharging the gas from the inside to the outside of the high-pressure-stage housing 7. Inside the high-pressure-stage housing 7, a supply passage 73 for guiding the gas introduced into the high-pressure-stage housing 7 from the high-pressure-stage inlet opening 71 to the high-pressure-stage impeller 5, and a scroll passage 74 for guiding the gas that has passed through the high-pressure-stage impeller 5 to the high-pressure-stage outlet opening 72 are formed. In the illustrated embodiment, each of the high-pressure-stage inlet opening 71 and the high-pressure-stage outlet opening 72 open in a direction intersecting (e.g., perpendicular to) the axis CA.

In the embodiment shown in FIG. 1, the high-pressure-stage impeller 5 includes a hub 51 mechanically connected to the other side of the rotational shaft 3 and a plurality of impeller blades 53 disposed on an outer peripheral surface 52 of the hub 51. The high-pressure-stage impeller 5 can rotate in conjunction with the rotational shaft 3 about the axis CA of the rotational shaft 3. The high-pressure-stage impeller 5 is composed of a centrifugal impeller configured to guide the gas sent from the high-pressure stage side XH along the axial direction X to the outer side in the radial direction Y. A gap (clearance) is formed between each of the tips 54 of the impeller blades 53 and a convexly curved shroud 75 of the high-pressure-stage housing 7.

In the embodiment shown in FIG. 1, the high-pressure-stage housing 7 is combined with another member (in the illustrated example, high-pressure-stage-side bearing housing 16B) to form a high-pressure-stage impeller chamber 76 rotatably accommodating the high-pressure-stage impeller 5. The high-pressure-stage impeller chamber 76 communicates with the supply passage 73 disposed upstream in the gas flow direction and the scroll passage 74 disposed downstream in the gas flow direction. The scroll passage 74 has a scroll shape surrounding the outer side of the high-pressure-stage impeller 5 in the radial direction Y. The shroud 75 defines a part of the high-pressure-stage impeller chamber 76.

The gas (e.g., air) introduced from the outside of the low-pressure-stage housing 6 to the supply passage 63 through the low-pressure-stage inlet opening 61 flows through the supply passage 63 to the high-pressure stage side XH, then is sent to the low-pressure-stage impeller 4, and is compressed by the rotation of the low-pressure-stage impeller 4 to be pressurized to the first pressure. The compressed gas (e.g., compressed air) having passed through the low-pressure-stage impeller 4 flows outward in the radial direction Y through the scroll passage 64, and then is discharged to the outside of the low-pressure-stage housing 6 through the low-pressure-stage outlet opening 62.

(Connecting Pipe)

As shown in FIG. 1, the connecting pipe 8 is formed in a tubular shape extending along its longitudinal direction, and includes at least a high-pressure-stage-side connection portion 81 connected to the high-pressure-stage inlet opening 71 and a low-pressure-stage-side connection portion 82 connected to the low-pressure-stage outlet opening 62. In the illustrated embodiment, each of the high-pressure-stage-side connection portion 81 and the low-pressure-stage-side connection portion 82 extends in a direction intersecting (e.g., perpendicular to) the axis CA of the rotational shaft 3. The connecting pipe 8 further includes an intermediate portion 83 extending along the axis CA of the rotational shaft 3, a low-pressure-stage-side curved portion 84 having a curved shape that connects the low-pressure-stage-side connection portion 82 and the intermediate portion 83, and a high-pressure-stage-side curved portion 85 having a curved shape that connects the high-pressure-stage-side connection portion 81 and the intermediate portion 83. In FIG. 1, the boundary of each portion of the connecting pipe 8 is shown by the dashed-dotted line. The portions of the connecting pipe 8 may be composed of separate members, or may be integrally formed from a single material.

The compressed gas discharged from the low-pressure-stage outlet opening 62 of the low-pressure-stage housing 6 flows through the connecting pipe 8 from the low-pressure-stage-side connection portion 82 to the high-pressure-stage-side connection portion 81, and then is introduced into the supply passage 73 through the high-pressure-stage inlet opening 71 of the high-pressure-stage housing 7. The compressed gas introduced into the supply passage 73 is sent to the high-pressure-stage impeller 5 and is compressed by the rotation of the high-pressure-stage impeller 5 to be pressurized to a second pressure higher than the first pressure. The compressed gas having passed through the high-pressure-stage impeller 5 flows outward in the radial direction Y through the scroll passage 74, and then is discharged to the outside of the high-pressure-stage housing 7 through the high-pressure-stage outlet opening 72.

In the illustrated embodiment, the multi-stage electric centrifugal compressor 1 comprises a multi-stage electric centrifugal compressor for a fuel cell vehicle. Therefore, the multi-stage electric centrifugal compressor 1 further includes a compressed gas supply line 21 for supplying the compressed gas compressed by the high-pressure-stage impeller 5 to a fuel cell 20. The fuel cell 20 comprises, for example, a solid oxide fuel cell (SOFC) and has a cathode 201, an anode 202, and a solid electrolyte 203 disposed between the cathode 201 and the anode 202. The compressed gas discharged from the high-pressure-stage outlet opening 72 of the high-pressure-stage housing 7 is supplied to the fuel cell 20 through the compressed gas supply line 21 connecting the high-pressure-stage outlet opening 72 and the cathode 201 of the fuel cell 20. The present disclosure may be applied to a multi-stage electric centrifugal compressor other than that for a fuel cell vehicle, for example, a multi-stage electric centrifugal compressor for an internal combustion engine for pressurizing a combustion gas supplied to an internal combustion engine such as an engine. That is, the compressed gas supply line 21 may be configured to connect the high-pressure-stage outlet opening 72 of the high-pressure-stage housing 7 to an internal combustion engine (not shown).

As shown in FIG. 1, the multi-stage electric centrifugal compressor 1 according to some embodiments includes at least a rotational shaft 3, a low-pressure-stage impeller 4 disposed at one end (low-pressure stage side XL) of the rotational shaft 3, a high-pressure-stage impeller 5 disposed at the other end (high-pressure stage side XH) of the rotational shaft 3, a high-pressure-stage housing 7 accommodating the high-pressure-stage impeller 5, and a connecting pipe 8 for supplying the compressed gas compressed by the low-pressure-stage impeller 4 to the high-pressure-stage housing 7. The high-pressure-stage housing 7 has a high-pressure-stage inlet opening 71 that opens in a direction intersecting (e.g., perpendicular to) the axis CA of the rotational shaft 3. The connecting pipe 8 includes a high-pressure-stage-side connection portion 81 connected to the high-pressure-stage inlet opening 71.

With the above configuration, the high-pressure-stage housing 7 has the high-pressure-stage inlet opening 71 that opens in a direction intersecting the axis CA of the rotational shaft 3, and the high-pressure-stage-side connection portion 81 of the connecting pipe 8 is connected to the high-pressure-stage inlet opening 71. Accordingly, the compressed gas pressurized by the low-pressure-stage impeller 4 is supplied from the outer peripheral side (the outer side in the radial direction Y) of the high-pressure-stage housing 7 into the high-pressure-stage housing 7 through the connecting pipe 8. In this case, as compared to the case where the compressed gas is introduced into the high-pressure-stage housing 7 along the axial direction X of the rotational shaft 3, the length of the connecting pipe 8 and the high-pressure-stage housing 7 in the axial direction X can be shortened. As a result, the length of the multi-stage electric centrifugal compressor 1 in the axial direction X can be shortened, so that the size and weight of the multi-stage electric centrifugal compressor 1 can be reduced.

Figure 2:
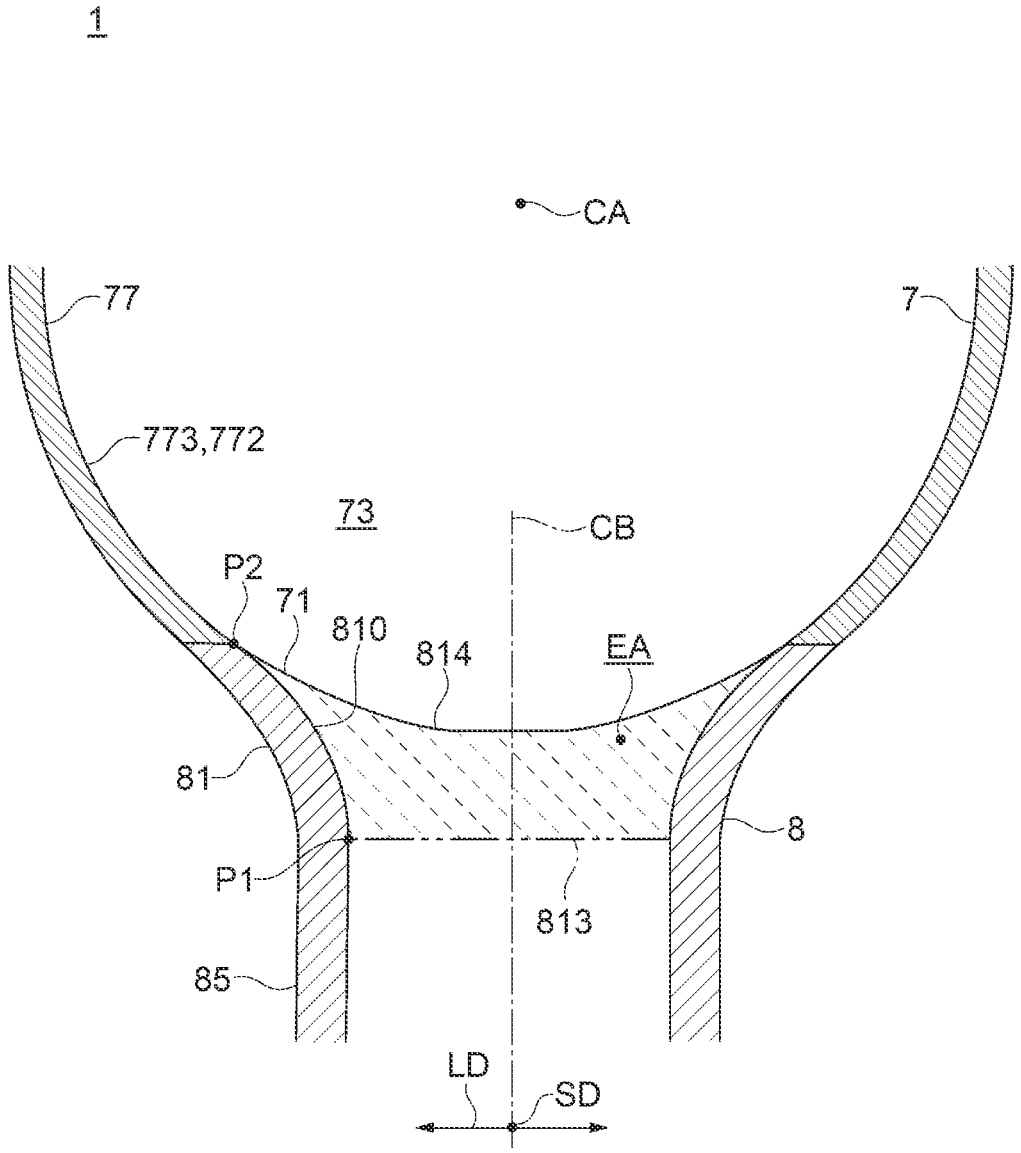
FIG. 2 is a schematic cross-sectional view schematically showing a cross-section of a high-pressure-stage connection portion of a connecting pipe and a high-pressure-stage housing shown in FIG. 1, as viewed from the high-pressure stage side in the axial direction.
Figure 3:
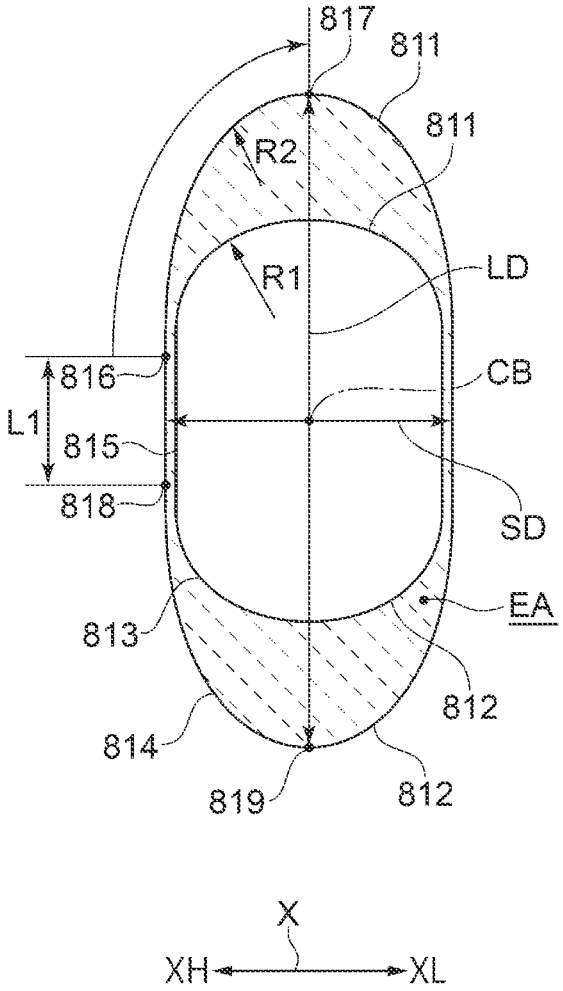
FIG. 3 is an explanatory view for describing the shape of the high-pressure-stage connection portion of the connecting pipe shown in FIG. 1.

FIG. 2 is a schematic cross-sectional view schematically showing a cross-section of the high-pressure-stage connection portion of the connecting pipe and the high-pressure-stage housing shown in FIG. 1, as viewed from the high-pressure stage side in the axial direction. FIG. 3 is an explanatory view for describing the shape of the high-pressure-stage connection portion of the connecting pipe shown in FIG. 1.

In some embodiments, as shown in FIG. 3, a flow path cross-section (e.g., flow path cross-sections 813, 814) of the high-pressure-stage-side connection portion 81 has a longitudinal direction LD along the direction perpendicular to the axis CA of the rotational shaft 3, and includes concavely curved portions 811, 812 formed at both ends in the longitudinal direction LD.

In the illustrated embodiment, as shown in FIG. 2, the high-pressure-stage-side connection portion 81 has an enlarged area EA where the flow-path cross-sectional area increases toward the high-pressure-stage inlet opening 71. The enlarged area EA is defined by an inner wall surface 810 of the high-pressure-stage-side connection portion 81. In the embodiment shown in FIG. 2, one side of the high-pressure-stage-side connection portion 81 connected to the high-pressure-stage inlet opening 71 is the end point P2 of the enlarged area EA, and the opposite side to the one side is the start point P1 of the enlarged area EA. The flow path cross-section 813 is a flow path cross-section at the start point P1 of the enlarged area EA, and the flow path cross-section 814 is a flow path cross-section at the end point P2 of the enlarged area EA.

With the above configuration, the flow path cross-section of the high-pressure-stage-side connection portion 81 has the longitudinal direction LD along the direction perpendicular to the axis CA of the rotational shaft 3, and includes the concavely curved portions 811, 812 formed at both ends in the longitudinal direction LD. In this case, since the high-pressure-stage-side connection portion 81 has an oval flow path cross-section extending along the longitudinal direction LD, the flow path area of the high-pressure-stage-side connection portion 81 can be increased while preventing the high-pressure-stage-side connection portion 81 from becoming large in the axial direction X of the rotational shaft 3. By increasing the flow path area of the high-pressure-stage-side connection portion 81, a necessary amount of the compressed gas can be supplied to the high-pressure-stage housing 7. Further, since the high-pressure-stage-side connection portion 81 has an oval flow path cross-section, the pressure loss of the compressed gas flowing through the high-pressure-stage-side connection portion 81 can be suppressed as compared to the case where the flow path cross-section is polygonal such as rectangular.

In some embodiments, as shown in FIG. 3, the flow path cross-section (e.g., flow path cross-sections 813, 814) of the high-pressure-stage-side connection portion 81 has a transverse direction SD along the axis CA of the rotational shaft 3. In this case, since the flow path cross-section of the high-pressure-stage-side connection portion 81 has the transverse direction SD along the axis CA, the length of the high-pressure-stage-side connection portion 81 in the axial direction X of the rotational shaft 3 can be shortened, so that the size and weight of the multi-stage electric centrifugal compressor 1 can be reduced.

In some embodiments, as shown in FIG. 3, the flow path cross-section (e.g., flow path cross-sections 813, 814) of the high-pressure-stage-side connection portion 81 further includes a straight portion 815 connecting the end portions of the pair of concavely curved portions 811, 812. The straight portion 815 has a predetermined length L1 in the longitudinal direction LD and has a constant length in the transverse direction SD. In this case, since the flow path cross-section of the high-pressure-stage-side connection portion 81 includes the straight portion 815, the velocity component of the compressed gas flowing through high-pressure-stage-side connection portion 81 toward the high-pressure-stage inlet opening 71 can be increased, which allows the compressed gas to smoothly flow to the high-pressure-stage impeller 5 through the high-pressure-stage inlet opening 71. Thus, it is possible to reduce the pressure loss of the compressed gas at the connection between the high-pressure-stage-side connection portion 81 and the high-pressure-stage inlet opening 71.

In some embodiments, as shown in FIGS. 2 and 3, the flow path cross-section of the high-pressure-stage-side connection portion 81 is formed such that the length along the longitudinal direction LD increases toward the high-pressure-stage inlet opening 71. In the illustrated embodiment, the length of the flow path cross-section 814 (at the end point P2 of the enlarged area EA) in the longitudinal direction LD is greater than the length of the flow path cross-section 813 (at the start point P1 of the enlarged area EA) in the longitudinal direction LD. In contrast, there is little variation in the length along the transverse direction SD from the start point P1 to the end point P2 of the enlarged area EA. The flow path cross-sectional area is enlarged by the increase in the length along the longitudinal direction LD.

With the above configuration, since the flow path cross-section of the high-pressure-stage-side connection portion 81 is formed such that the length in the longitudinal direction increases toward the high-pressure-stage inlet opening 71, the compressed gas flowing along the inner wall surface 810 of the high-pressure-stage-side connection portion 81 can still flow along an inner wall surface 77 that defines the supply passage 73 of the high-pressure-stage housing 7. By flowing the compressed gas along the inner wall surface 77 of the high-pressure-stage housing 7, the separation of the compressed gas from the inner wall surface 77 can be suppressed, so that the pressure loss of the compressed gas in the supply passage 73 of the high-pressure-stage housing 7 can be reduced.

In some embodiments, as shown in FIG. 2, the high-pressure-stage inlet opening 71 is formed in an inner peripheral wall surface 772 that defines the outer peripheral side of the supply passage 73. The inner wall surface 810 of the high-pressure-stage-side connection portion 81 and the inner peripheral wall surface 772 of the high-pressure-stage housing 7 are gently connected. Here, the expression "gently connected" means that the boundary between the inner wall surface 77 and the inner peripheral wall surface 772 has no sharp edge but is rounded. In the illustrated embodiment, the inner wall surface 810 has a convexly curved shape. In order to reduce the pressure loss of the compressed gas at the connection between the high-pressure-stage-side connection portion 81 and the high-pressure-stage inlet opening 71, the curvature of the portion of the inner peripheral wall surface 772 connected to the inner wall surface 77 should be as large as possible. With the above configuration, since the inner wall surface 810 of the high-pressure-stage-side connection portion 81 and the inner peripheral wall surface 772 of the high-pressure-stage housing 7 are gently connected, the pressure loss of the compressed gas at the connection between the high-pressure-stage-side connection portion 81 and the high-pressure-stage inlet opening 71 can be reduced.

In some embodiments, as shown in FIG. 3, the flow path cross-section of the high-pressure-stage-side connection portion 81 is formed such that the maximum curvature of the concavely curved portions 811, 812 increases toward the high-pressure-stage inlet opening 71. In the illustrated embodiment, the maximum curvature R2 of the convexly curved portions 811, 812 in the flow path cross-section 814 (at the end point P2 of the enlarged area EA) is greater than the maximum curvature R1 of the concavely curved portions 811, 812 in the flow path cross-section 813 (at the start point P1 of the enlarged area EA). In the illustrated embodiment, each of the concavely curved portions 811, 812 in the flow path cross-section 813 is formed such that the curvature is constant from the connection end with the straight portion 815 to one end in the longitudinal direction LD. In contrast, each of the concavely curved portions 811, 812 in the flow path cross-section 814 is formed such that the curvature increases from the connection end 816, 818 with the straight portion 815 to one end 817, 819 in the longitudinal direction LD. In an embodiment, the maximum curvature R2 is at least twice the maximum curvature R1.

With the above configuration, since the flow path cross-section of the high-pressure-stage-side connection portion 81 is formed such that the maximum curvature of the concavely curved portions 811, 812 increases toward the high-pressure-stage inlet opening 71, the compressed gas flowing through the high-pressure-stage-side connection portion 81 can be smoothly guided to the high-pressure-stage inlet opening 71. Thus, it is possible to reduce the pressure loss of the compressed gas at the connection between the high-pressure-stage-side connection portion 81 and the high-pressure-stage inlet opening 71.

In some embodiments, as shown in FIG. 1, the connecting pipe 8 includes the high-pressure-stage-side connection portion 81, the low-pressure-stage-side connection portion 82, the intermediate portion 83, the low-pressure-stage-side curved portion 84, and the high-pressure-stage-side curved portion 85. Further, at least the flow path cross-section of the low-pressure-stage-side connection portion 82 is formed in a circular shape. In the illustrated embodiment, not only the low-pressure-stage-side connection portion 82 but the low-pressure-stage-side connection portion 82 and the intermediate portion 83 have a circular flow path cross-section. Further, the flow path cross-section changes in the high-pressure-stage-side curved portion 85 from a circular to an oval shape.

The compressed gas supplied from the low-pressure-stage housing 6 to the connecting pipe (8) has a swirling component. With the above configuration, since at least the low-pressure-stage-side connection portion 82 of the connecting pipe 8 has a circular flow path cross-section, the pressure loss of the compressed gas having a swirl component flowing through the connecting pipe 8 can be reduced. Additionally, when the low-pressure-stage-side connection portion 82 and the intermediate portion 83 have a circular flow path cross-section, the pressure loss of the compressed gas having a swirl component flowing through the connecting pipe 8 can be further reduced.

Figure 4:
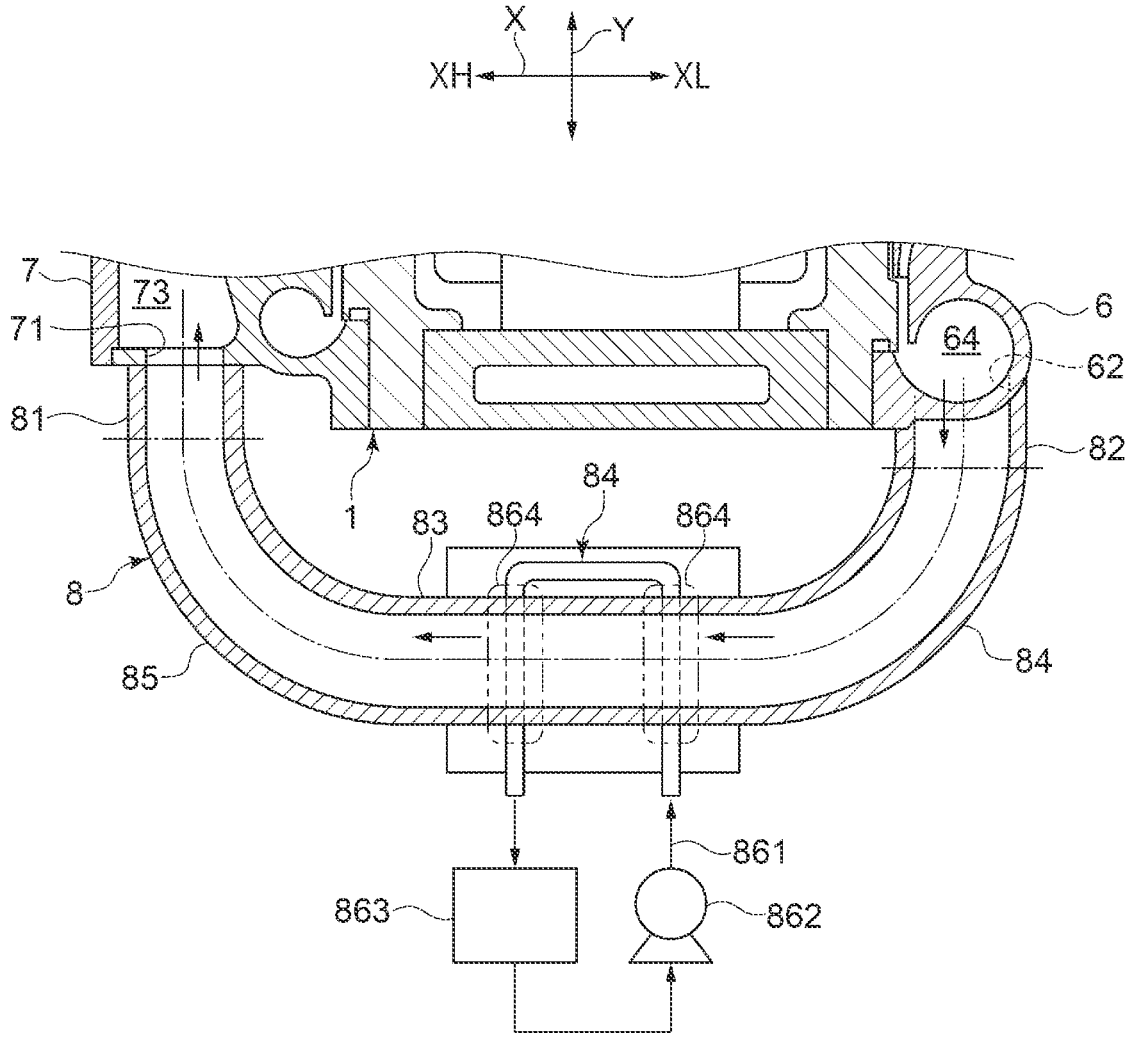
FIG. 4 is a schematic configuration diagram in the vicinity of a connecting pipe of a multi-stage electric centrifugal compressor according to an embodiment of the present disclosure.

FIG. 4 is a schematic configuration diagram in the vicinity of a connecting pipe of a multi-stage electric centrifugal compressor according to an embodiment of the present disclosure. FIG. 4 schematically shows a cross-section of the multi-stage electric centrifugal compressor 1 taken along the axis CA of the rotational shaft 3.

In some embodiments, as shown in FIG. 4, the multi-stage electric centrifugal compressor 1 further includes a cooling device 86 configured to perform heat exchange between the compressed gas in the connecting pipe 8 and a cooling liquid (e.g., cooling water) for cooling the compressed gas. The compressed gas compressed by the low-pressure-stage impeller 4 is cooled by the cooling device 86 and then supplied to the high-pressure-stage impeller 5.

In the illustrated embodiment, the cooling device 86 includes a cooling liquid circulation line 861 for circulating a cooling liquid as a cooling medium, a cooling liquid circulation pump 862 configured to send the cooling liquid, and a radiator 863 configured to cool the cooling liquid. The cooling liquid circulation line 861 has a heat exchange part 864 for exchanging heat between the compressed gas in the connecting pipe 8 and the cooling liquid. The cooling liquid circulation pump 862 is disposed on the cooling liquid circulation line 861 upstream of the heat exchange part 864 in the cooling liquid flow direction, and sends the cooling liquid downstream. The radiator 863 is disposed on the cooling liquid circulation line 861 upstream of the heat exchange part 864 in the cooling liquid flow direction, and cools the cooling liquid heated by the heat exchange with the compressed gas. This makes the cooling liquid in the heat exchange part 864 cooler than the compressed gas in the connecting pipe 8, which is the heat exchange target. The cooling device 86 is not limited to the illustrated embodiment, as long as it can perform heat exchange between the compressed gas in the connecting pipe 8 and the cooling liquid.

With the above configuration, the compressed gas flowing through the connecting pipe 8 is cooled by the heat exchange between the compressed gas in the connecting pipe 8 and the cooling liquid in the cooling device 86. By cooling the compressed gas sent to the high-pressure-stage impeller 5 with the cooling device 86, the temperature rise of the compressed gas having passed through the high-pressure-stage impeller 5 can be suppressed. Thus, it is possible to improve the compression ratio in the high-pressure stage of the multi-stage electric centrifugal compressor 1. Further, when the temperature rise of the compressed gas having passed through the high-pressure-stage impeller 5 is suppressed, the temperature rise of gas in a space 24 facing the back surface 57 of the high-pressure-stage impeller 5 can be suppressed, so that the amount of heat input from the back surface 57 of the high-pressure-stage impeller 5 to the bearing 15 (particularly, high-pressure-stage-side grease-filled bearing 15B) can be reduced. This suppresses heat-induced deterioration of the bearing 15, thereby improving the life and durability of the bearing 15.

In some embodiments, as shown in FIG. 1, the high-pressure-stage housing 7 includes an inner wall surface 77 that defines the supply passage 73 for leading the compressed gas supplied from the high-pressure-stage inlet opening 71 to the high-pressure-stage impeller 5. The inner wall surface 77 includes an inner end wall surface 771 that defines the side (high-pressure stage side XH) of the supply passage 73 opposite to the high-pressure-stage impeller and an inner peripheral wall surface 772 that defines the outer peripheral side (outer side in the radial direction Y) of the supply passage 73. The high-pressure-stage housing 7 further includes a guide protruding portion 78 that protrudes from the inner end wall surface 771 toward the high-pressure-stage impeller 5. In the illustrated embodiment, the outer peripheral surface of the guide protruding portion 78 is formed in a concavely curved shape.

With the above configuration, the guide protruding portion 78 that protrudes from the inner end wall surface 771 toward the high-pressure-stage impeller 5 guides the compressed gas flowing through the supply passage 73 of the high-pressure-stage housing 7 to the high-pressure-stage impeller 5. For example, the flow of compressed gas flowing inward in the radial direction Y along the inner end wall surface 771 can be turned along the outer peripheral surface of the guide protruding portion 78 and changed into a flow toward the low-pressure stage side XL in the axial direction X. In this case, since the guide protruding portion 78 allows the compressed gas to be led to the high-pressure-stage impeller 5 along the axial direction, as compared to the case where the compressed gas is led to the high-pressure-stage impeller 5 from the outer side in the radial direction, the efficiency of the multi-stage electric centrifugal compressor 1 can be improved.

Figure 5:
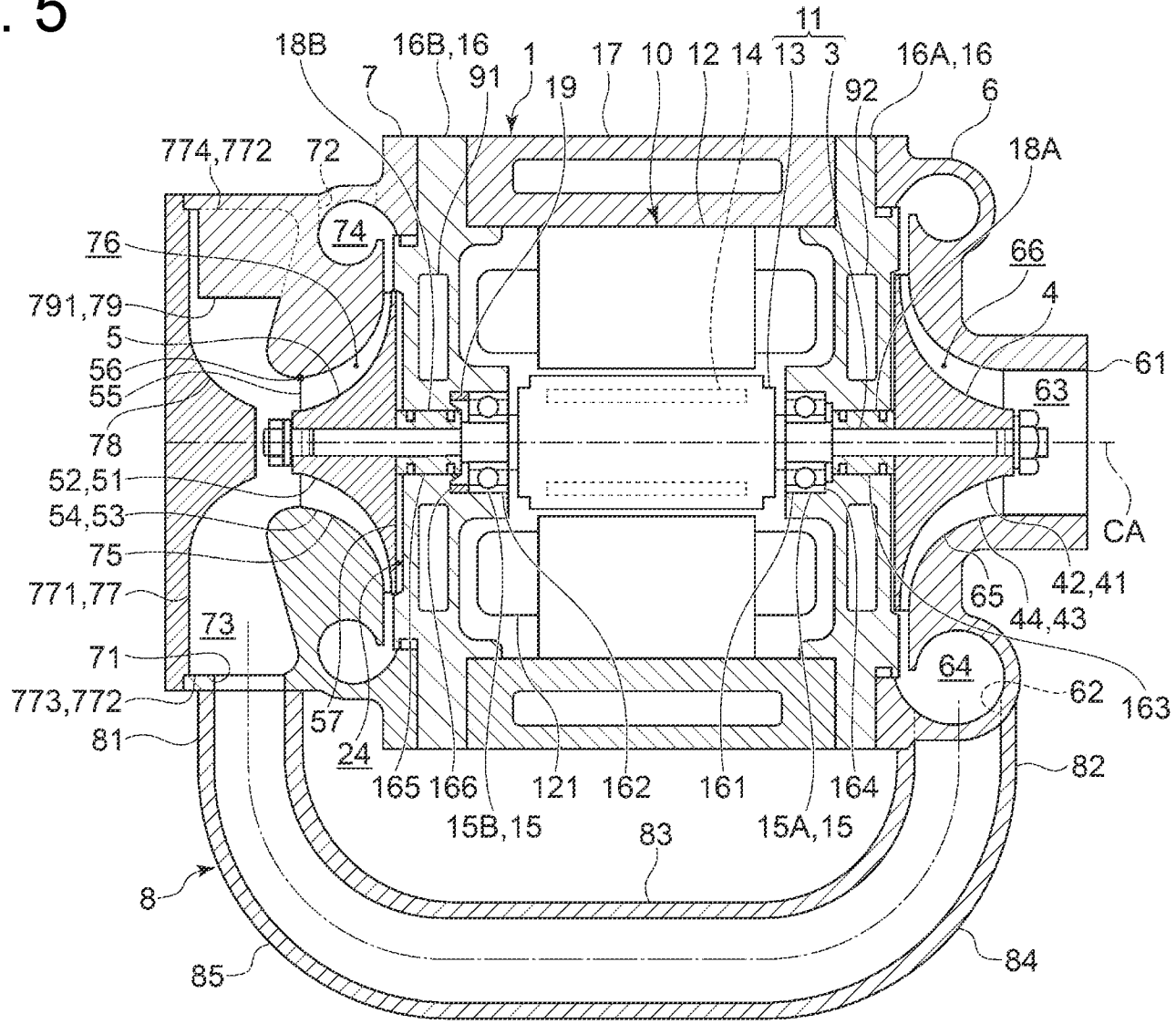
FIG. 5 is a schematic configuration diagram schematically showing a configuration of a multi-stage electric centrifugal compressor according to an embodiment of the present disclosure.
Figure 6:
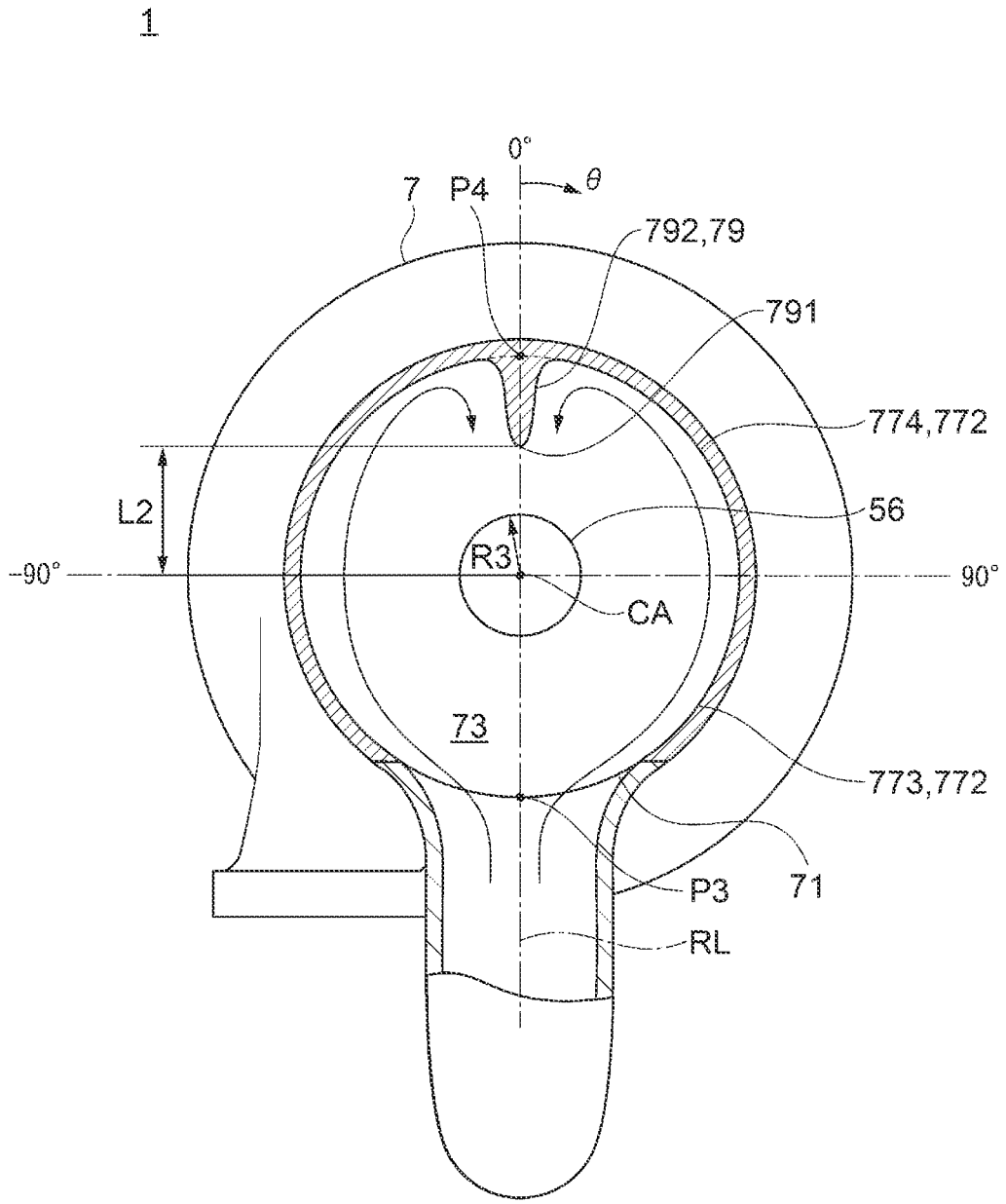
FIG. 6 is a schematic cross-sectional view schematically showing a cross-section of a high-pressure-stage housing shown in FIG. 5, as viewed from the high-pressure stage side in the axial direction.

FIG. 5 is a schematic configuration diagram schematically showing a configuration of a multi-stage electric centrifugal compressor according to an embodiment of the present disclosure. FIG. 6 is a schematic cross-sectional view schematically showing a cross-section of a high-pressure-stage housing shown in FIG. 5, as viewed from the high-pressure stage side in the axial direction. FIG. 5 schematically shows a cross-section of the multi-stage electric centrifugal compressor 1 taken along the axis CA of the rotational shaft 3.

In some embodiments, as shown in FIG. 5, the inner peripheral wall surface 772 has an inlet-side inner peripheral wall surface 773 formed with the high-pressure-stage inlet opening 71, and an opposite-side inner peripheral wall surface 774 disposed opposite to the high-pressure-stage inlet opening 71. The high-pressure-stage housing 7 includes an anti-swirl plate 79 that protrudes from the opposite-side inner peripheral wall surface 774.

As shown in FIG. 6, in a cross-section of the high-pressure-stage housing 7 viewed from the high-pressure stage side XH in the axial direction X, the position of the intersection P4 between the center P3 of the high-pressure-stage inlet opening 71 and the reference line RL passing through the axis CA of the rotational shaft 3 is defined as the 0° position, the clockwise direction about the axis CA is defined as the forward direction, and the angle along the circumferential direction of the rotational shaft 3 in the forward direction with respect to the 0° position is defined as θ. The tip 791 of the anti-swirl plate 79 closest to the axis CA is in the range of $-90° \leq \theta \leq 90°$. In the illustrated embodiment, the anti-swirl plate 79 has an outer surface (inclination surface) 792 that is inclined so that the width dimension decreases toward the tip 791.

FIG. 6 shows a tip end 56 of a leading edge 55 of the high-pressure-stage impeller as corresponding to the inlet of the high-pressure-stage impeller 5. As shown in FIG. 6, the flow of the compressed gas flowing through the supply passage 73 along the inner peripheral wall surface 772 in the clockwise direction or the counterclockwise direction can be turned along the outer surface 792 of the anti-swirl plate 79 and changed into a flow toward the inlet of the high-pressure-stage impeller 5. If the high-pressure-stage housing 7 does not include the anti-swirl plate 79, the compressed gas flowing through the supply passage 73 along the inner peripheral wall surface 772 in the clockwise direction collides with the compressed gas flowing through the supply passage 73 along the inner peripheral wall surface 772 in the counterclockwise direction, resulting in pressure loss in the supply passage 73.

With the above configuration, the anti-swirl plate 79 can suppress the collision between the compressed gas flowing through the supply passage 73 of the high-pressure-stage housing 7 in one direction in the circumferential direction of the rotational shaft 3 and the compressed gas flowing through the supply passage 73 in the opposite direction to the one direction in the circumferential direction. Further, the anti-swirl plate 79 guides the compressed gas flowing along the opposite-side inner peripheral wall surface 774 to the inner side in the radial direction where the high-pressure-stage impeller 5 is located, thereby smoothly guiding the compressed gas flowing from the high-pressure-stage inlet opening 71 to the high-pressure-stage impeller 5. Thus, it is possible to reduce the pressure loss of the compressed gas in the supply passage 73 of the high-pressure-stage housing 7.

In some embodiments, as shown in FIG. 6, the tip 791 of the anti-swirl plate 79 is located on a further outer peripheral side of the rotational shaft 3 than the tip end 56 of the leading edge 55 of the high-pressure-stage impeller 5 (corresponding to the inlet of the high-pressure-stage impeller 5).

If the tip 791 of the anti-swirl plate 79 is located on a further inner peripheral side of the rotational shaft 3 than the tip end 56 of the leading edge 55 of the high-pressure-stage impeller 5, the compressed gas guided by the anti-swirl plate 79 and led to the high-pressure-stage impeller 5 has a strong radially inward velocity component, which may reduce the compression efficiency of the high-pressure-stage impeller 5. With the above configuration, since the tip 791 of the anti-swirl plate 79 is located on a further outer peripheral side of the rotational shaft 3 than the tip end 56 of the leading edge 55 of the high-pressure-stage impeller 5, the compressed gas guided by the anti-swirl plate 79 and led to the high-pressure-stage impeller 5 has a smaller radially inward velocity component. Thus, it is possible to suppress the decrease in the compression efficiency in the high-pressure-stage impeller 5.

As shown in FIG. 6, in a cross-section of the high-pressure-stage housing 7 viewed from the high-pressure stage side XH in the axial direction X, the distance from the tip 791 of the anti-swirl plate 79 to the axis CA of the rotational shaft 3 is defined as L2, and the radius of the tip end 56 (length from the axis CA) is defined as R3. If L2 is too large, the protrusion length of the anti-swirl plate 79 from the opposite-side inner peripheral wall surface 774 is small, making it difficult for the anti-swirl plate 79 to change the flow of the compressed gas. Further, if L2 is too small, as described above, the compressed gas guided by the anti-swirl plate 79 and led to the high-pressure-stage impeller 5 has a strong radially inward velocity component, which may reduce the compression efficiency of the high-pressure-stage impeller 5. Therefore, the above-described L2 preferably satisfies the condition of $1.5R3 \leq L2 \leq 2.5R3$.

Each of the multi-stage electric centrifugal compressors 1 according to some embodiments described below can be implemented independently. For example, it can be applied to, for example, a multi-stage electric centrifugal compressor with a high-pressure-stage inlet opening 71 that opens toward the high-pressure stage side XH in the axial direction X. The multi-stage electric centrifugal compressors 1 according to some embodiments below may be combined with each other or with the multi-stage electric centrifugal compressors 1 according to some embodiments described above.

(Grease-Filled Bearing)

Figure 7:
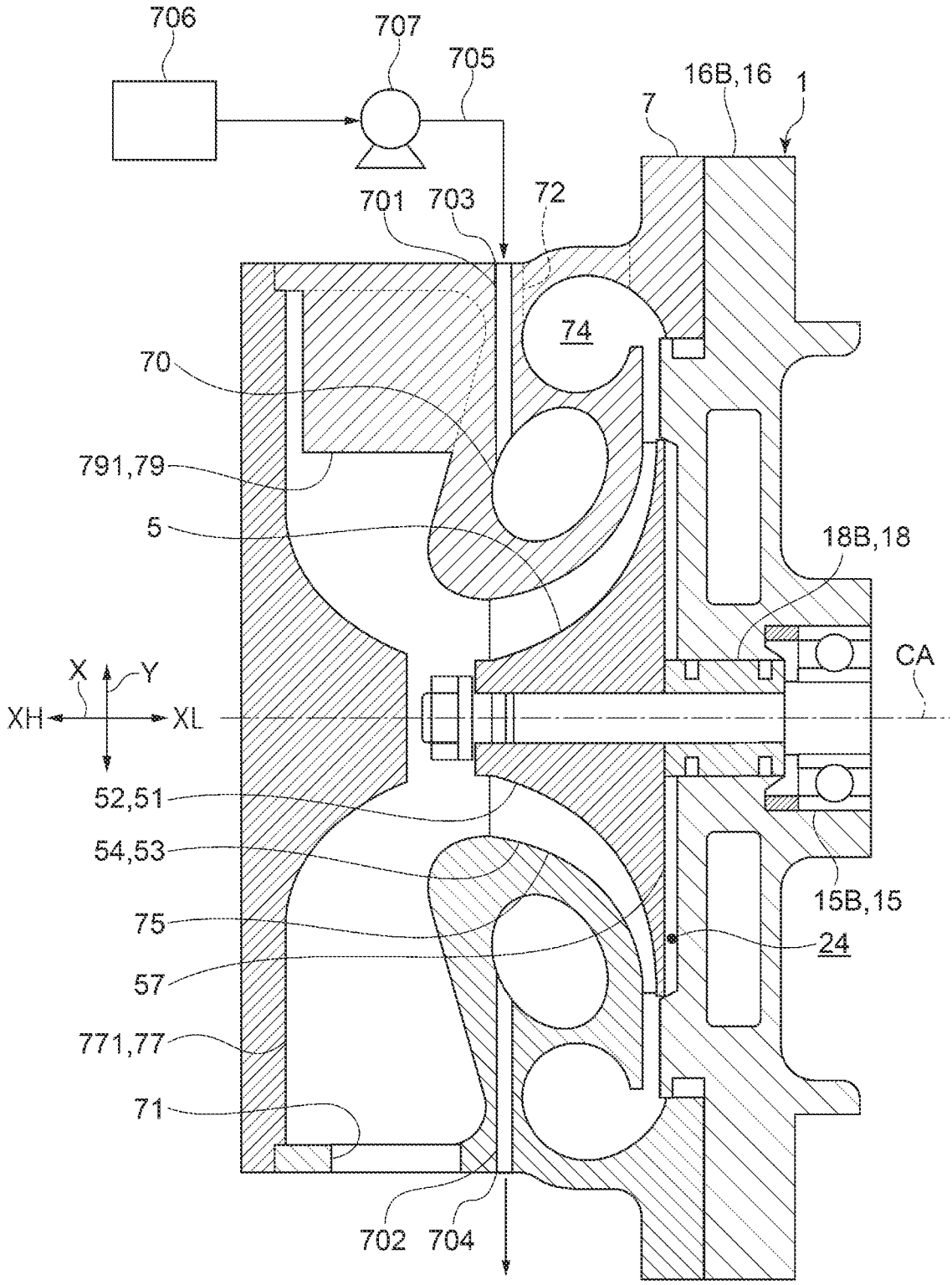
FIG. 7 is a schematic configuration diagram in the vicinity of a high-pressure-stage housing of a multi-stage electric centrifugal compressor according to an embodiment of the present disclosure.
Figure 8:
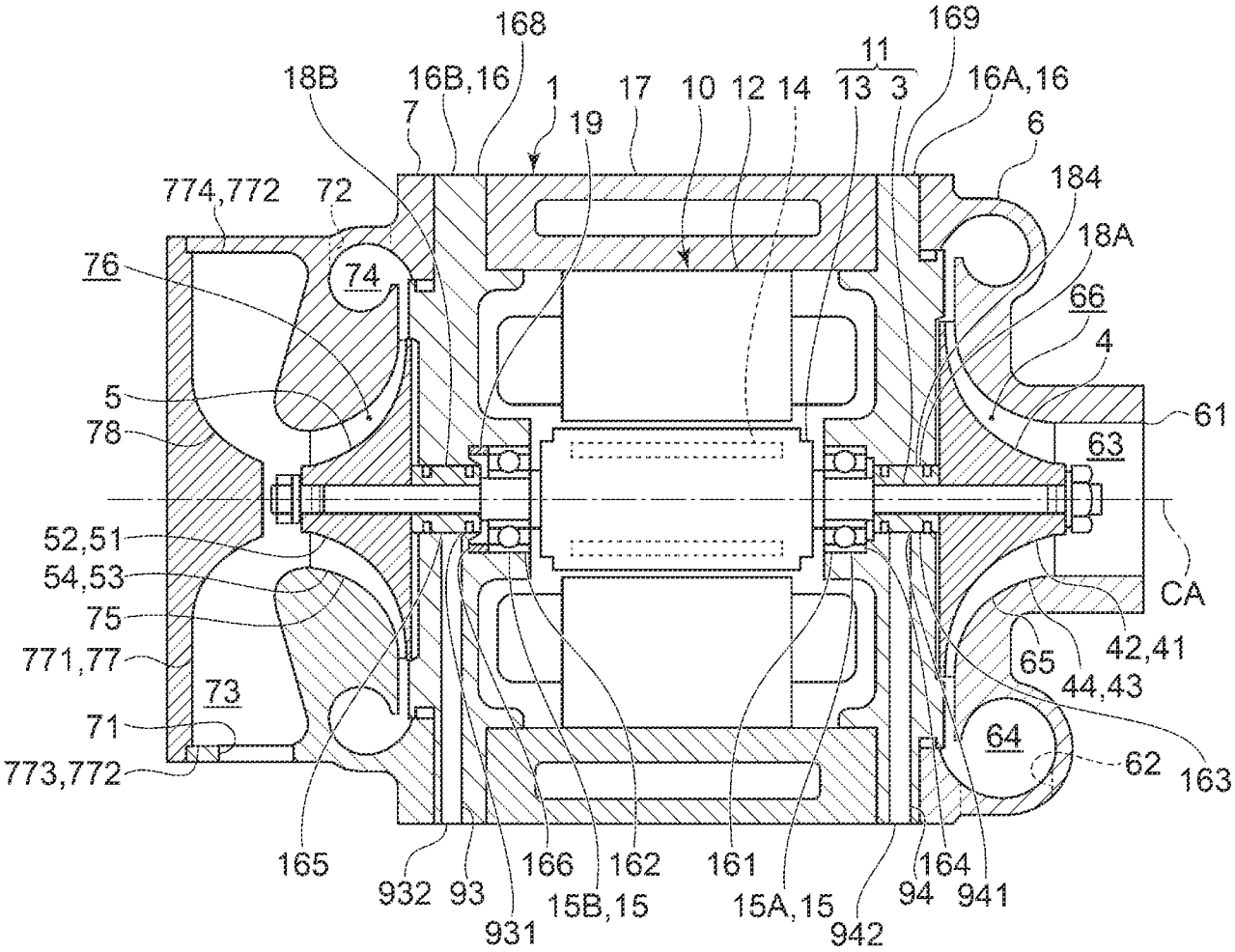
FIG. 8 is a schematic configuration diagram schematically showing a configuration of a multi-stage electric centrifugal compressor according to an embodiment of the present disclosure.
Figure 9:
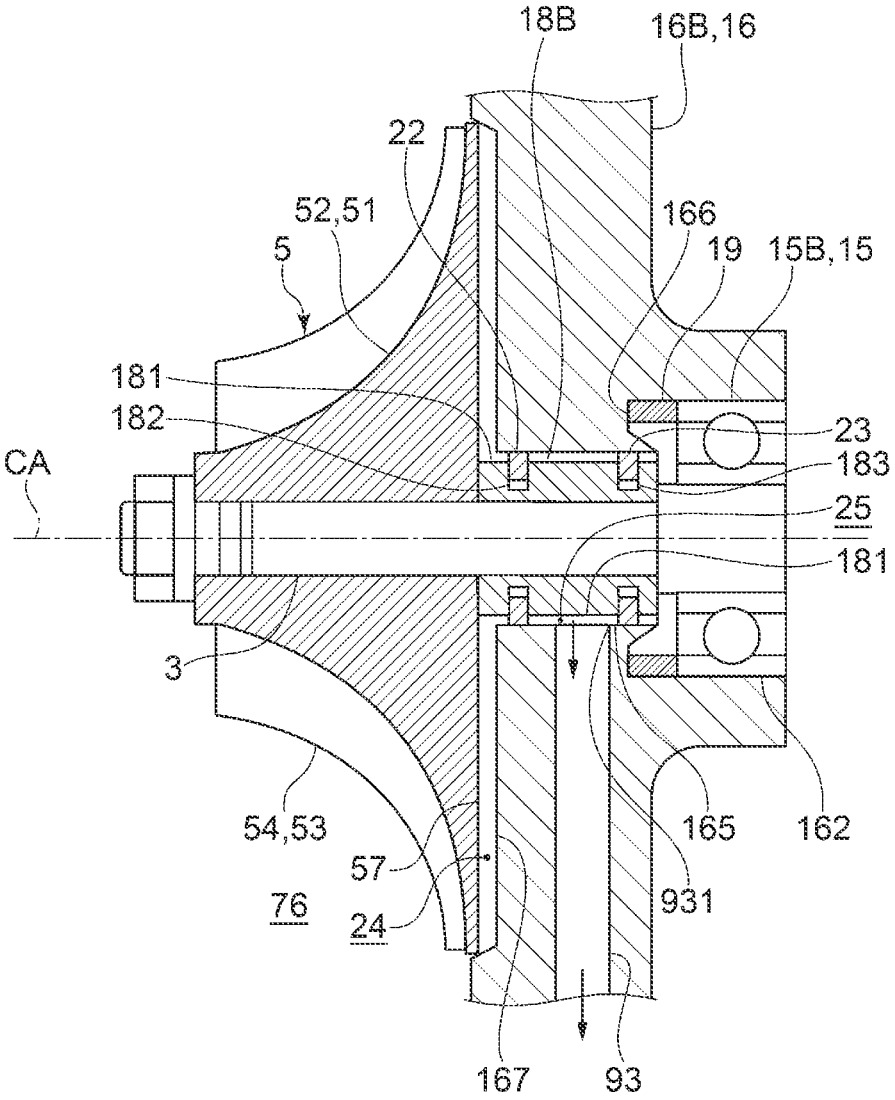
FIG. 9 is a schematic cross-sectional view in the vicinity of a high-pressure-stage-side sleeve of FIG. 8.
Figure 10:
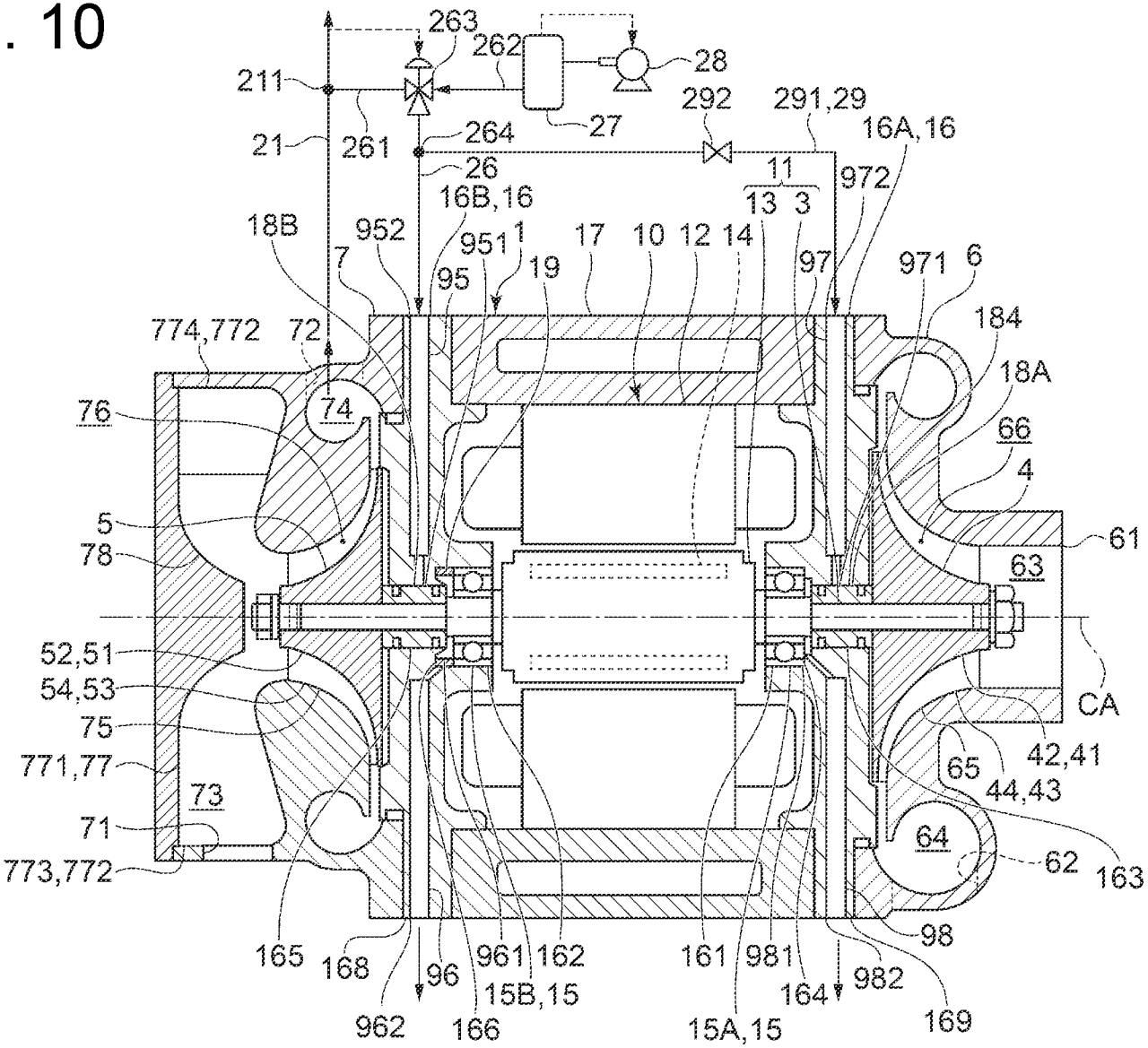
FIG. 10 is a schematic configuration diagram schematically showing a configuration of a multi-stage electric centrifugal compressor according to an embodiment of the present disclosure.
Figure 11:
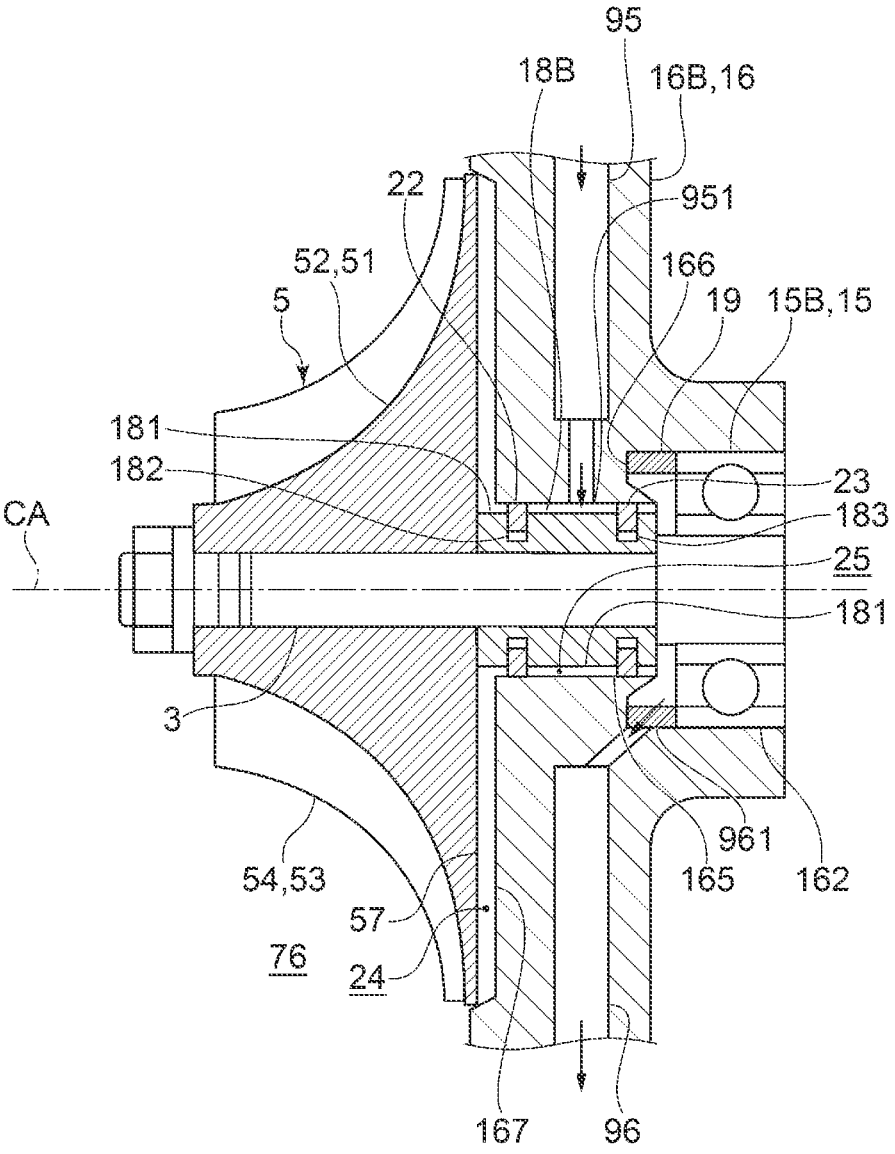
FIG. 11 is a schematic cross-sectional view in the vicinity of the high-pressure-stage-side sleeve of FIG. 10.

FIG. 7 is a schematic configuration diagram in the vicinity of a high-pressure-stage housing of a multi-stage electric centrifugal compressor according to an embodiment of the present disclosure. FIG. 8 is a schematic configuration diagram schematically showing a configuration of a multi-stage electric centrifugal compressor according to an embodiment of the present disclosure. FIG. 9 is a schematic cross-sectional view in the vicinity of a high-pressure-stage-side sleeve of FIG. 8. FIG. 10 is a schematic configuration diagram schematically showing a configuration of a multi-stage electric centrifugal compressor according to an embodiment of the present disclosure. FIG. 11 is a schematic cross-sectional view in the vicinity of a high-pressure-stage-side sleeve of FIG. 10. In FIGS. 7, 8, and 10, the multi-stage electric centrifugal compressor 1 is shown in a cross-section taken along the axis CA of the rotational shaft 3, and the connecting pipe 8 is omitted.

As shown in FIGS. 5, 8, and 10, the multi-stage electric centrifugal compressor 1 according to some embodiments includes a rotational shaft 3, a low-pressure-stage impeller 4 disposed at one end (low-pressure stage side XL) of the rotational shaft 3, a high-pressure-stage impeller 5 disposed at the other end (high-pressure stage side XH) of the rotational shaft 3, at least one bearing 15 rotatably supporting the rotational shaft 3 and disposed between the high-pressure-stage impeller 5 and the low-pressure-stage impeller 4, and a bearing housing 16 accommodating the at least one bearing 15. The at least one bearing 15 includes a high-pressure-stage-side grease-filled bearing 15B disposed between the high-pressure-stage impeller 5 and the electric motor 10 (rotor assembly 13). In other words, the high-pressure-stage-side bearing 15B comprises a grease-filled bearing in which grease is previously packed. In the illustrated embodiment, the bearing housing 16 includes a high-pressure-stage-side bearing housing 16B accommodating the high-pressure-stage-side grease-filled bearing 15B.

With the above configuration, the multi-stage electric centrifugal compressor 1 includes the high-pressure-stage-side grease-filled bearing 15B in which grease is previously packed. In this case, since it is not necessary to supply grease to the high-pressure-stage-side grease-filled bearing 15B, the structure of parts (e.g., high-pressure-stage-side bearing housing 16B) around the high-pressure-stage-side grease-filled bearing 15B can be simplified, so that the size and weight of the multi-stage electric centrifugal compressor 1 can be reduced.

In the multi-stage electric centrifugal compressor 1 according to some embodiments, as shown in FIGS. 5, 8, and 10, the at least one bearing 15 includes the high-pressure-stage-side grease-filled bearing 15B and a low-pressure-stage-side grease-filled bearing 15A disposed between the low-pressure-stage impeller 4 and the electric motor 10 (rotor assembly 13). In other words, the low-pressure-stage-side bearing 15A comprises a grease-filled bearing in which grease is previously packed. In the illustrated embodiment, the bearing housing 16 includes the high-pressure-stage-side bearing housing 16B, and a low-pressure-stage-side bearing housing 16A accommodating the low-pressure-stage-side grease-filled bearing 15A.

With the above configuration, the multi-stage electric centrifugal compressor 1 includes the low-pressure-stage-side grease-filled bearing 15A in which grease is previously packed. In this case, since it is not necessary to supply grease to the low-pressure-stage-side grease-filled bearing 15A, the structure of parts (e.g., low-pressure-stage-side bearing housing 16A) around the low-pressure-stage-side grease-filled bearing 15A can be simplified, so that the size and weight of the multi-stage electric centrifugal compressor 1 can be reduced.

In order to suppress heat-induced deterioration of the high-pressure-stage-side grease-filled bearing 15B and the low-pressure-stage-side grease-filled bearing 15A, it is desirable to provide a mechanism for suppressing heat transfer from the back surfaces of the high-pressure-stage impeller 5 and the low-pressure-stage impeller 4 to the bearings 15A and 15B.

(Cooling Passage of Bearing Housing)

In some embodiments, as shown in FIG. 5, the bearing housing 16 (high-pressure-stage-side bearing housing 16B) has a cooling passage 91 formed between the high-pressure-stage-side grease-filled bearing 15B and the high-pressure-stage impeller 5 in the axial direction X of the rotational shaft 3. In the illustrated embodiment, the cooling passage 91 is disposed on the outer peripheral side of the high-pressure-stage-side sleeve 18B. The cooling passage 91 extends along the circumferential direction of the rotational shaft 3. The cooling passage 91 may be formed in an annular shape or an arc shape in a cross-section along the direction perpendicular to the axis CA. In the illustrated embodiment, the cooling passage 91 is filled with gas (e.g., air), but the cooling passage 91 may be filled with cooling water. The multi-stage electric centrifugal compressor 1 may include a cooling water supply line (not shown) for supplying cooling water to the cooling passage 91.

With the above configuration, the bearing housing 16 (high-pressure-stage-side bearing housing 16B) has the cooling passage 91 formed between the high-pressure-stage-side grease-filled bearing 15B and the high-pressure-stage impeller 5 in the axial direction X of the rotational shaft 3. Thus, the cooling passage 91 can suppress the heat transfer from the back surface 57 of the high-pressure-stage impeller 5 to the high-pressure-stage-side grease-filled bearing 15B. This suppresses heat-induced deterioration of the high-pressure-stage-side grease-filled bearing 15B, thereby improving the life and durability of the high-pressure-stage-side grease-filled bearing 15B.

The inner end of the cooling passage 91 in the radial direction Y is preferably located near the inner surface 165 of the high-pressure-stage-side bearing housing 16B. This can effectively suppress the heat transfer from the high-pressure-stage impeller 5 or the gas in the space 24 facing the back surface 57 of the high-pressure-stage impeller 5 to the high-pressure-stage-side sleeve 18B or the high-pressure-stage-side bearing housing 16B through a gap 25 (see FIG. 9) formed between the outer peripheral surface 181 (see FIG. 9) of the high-pressure-stage-side sleeve 18B and the inner surface 165.

The cooling passage may be formed on the low-pressure stage side. In some embodiments, as shown in FIG. 5, the bearing housing 16 (low-pressure-stage-side bearing housing 16A) has a cooling passage 92 formed between the low-pressure-stage-side grease-filled bearing 15A and the low-pressure-stage impeller 4 in the axial direction X of the rotational shaft 3. In the illustrated embodiment, the cooling passage 92 is disposed on the outer peripheral side of the low-pressure-stage-side grease-filled bearing 15A. The cooling passage 92 extends along the circumferential direction of the rotational shaft 3. The cooling passage 92 may be formed in an annular shape or an arc shape in a cross-section along the direction perpendicular to the axis CA. In the illustrated embodiment, the cooling passage 92 is filled with gas (e.g., air), but the cooling passage 92 may be filled with cooling water. The multi-stage electric centrifugal compressor 1 may include a cooling water supply line (not shown) for supplying cooling water to the cooling passage 92.

With the above configuration, the bearing housing 16 (low-pressure-stage-side bearing housing 16A) has the cooling passage 92 formed between the low-pressure-stage-side grease-filled bearing 15A and the low-pressure-stage impeller 4 in the axial direction X of the rotational shaft 3. Thus, the cooling passage 92 can suppress the heat transfer from the back surface of the low-pressure-stage impeller 4 to the low-pressure-stage-side grease-filled bearing 15A. This suppresses heat-induced deterioration of the low-pressure-stage-side grease-filled bearing 15A, thereby improving the life and durability of the low-pressure-stage-side grease-filled bearing 15A.

(Cooling Passage of High-Pressure-Stage Housing)

In some embodiments, as shown in FIG. 7, the high-pressure-stage housing 7 has a high-pressure-stage-side cooling passage 70 formed on a further outer peripheral side of the rotational shaft 3 than the high-pressure-stage impeller 5. A heat medium (e.g., cooling liquid) having a lower temperature than the high-pressure-stage housing 7 flows through the high-pressure-stage-side cooling passage 70, and heat is transferred from the compressed gas supplied to the high-pressure-stage impeller 5 in the high-pressure-stage housing 7 to the high-pressure stage-side cooling passage 70 via the high-pressure-stage housing 7. In the illustrated embodiment, the high-pressure-stage-side cooling passage 70 is formed between the surface that forms the radially inner side of the scroll passage 64 and the shroud 65.

In the embodiment shown in FIG. 7, the high-pressure-stage-side cooling passage 70 is formed in an annular shape extending along the circumferential direction of the rotational shaft 3. The high-pressure-stage-side cooling passage 70 may be formed in an arc shape extending along the circumferential direction of the rotational shaft 3. The high-pressure-stage housing 7 has an inlet passage 701 for introducing the cooling liquid to the high-pressure-stage-side cooling passage 70 and an outlet passage 702 for discharging the cooling liquid from the high-pressure-stage-side cooling passage 70. The inlet passage 701 connects a cooling liquid introduction port 703 formed on the outer surface of the high-pressure-stage housing 7 and the high-pressure-stage-side cooling passage 70 to allow the cooling liquid to flow. The outlet passage 702 connects a cooling liquid discharge port 704 formed on the outer surface of the high-pressure-stage housing 7 and the high-pressure-stage-side cooling passage 70 to allow the cooling liquid to flow.

Further, in the embodiment shown in FIG. 7, the multi-stage electric centrifugal compressor 1 includes a cooling liquid supply line 705 for sending a cooling liquid to the high-pressure-stage-side cooling passage 70, a cooling liquid storage device (cooling liquid storage tank) 706 configured to store the cooling liquid, and a cooling liquid circulation pump 707 configured to send the cooling liquid downstream in the cooling liquid supply line 705. The cooling liquid storage device 706 is disposed upstream of the cooling liquid circulation pump 707 on the cooling liquid supply line 705. The downstream end of the cooling liquid supply line 705 is connected to the cooling liquid introduction port 703 of the inlet passage 701. As the cooling liquid circulation pump 707 sends the cooling liquid downstream in the cooling liquid supply line 705, the cooling liquid enters the high-pressure-stage-side cooling passage 70 through the inlet passage 701. The cooling liquid entering the high-pressure-stage-side cooling passage 70 flows through the high-pressure-stage-side cooling passage 70 along the circumferential direction of the rotational shaft 3, then flows through the outlet passage 702 and is discharged from the cooling liquid discharge port 704 to the outside of the high-pressure-stage housing 7. The cooling liquid discharged from the cooling liquid discharge port 704 to the outside of the high-pressure-stage housing 7 may be cooled by a heat exchanger or the like and then introduced into the high-pressure-stage-side cooling passage 70 again through the inlet passage 701.

With the above configuration, the high-pressure-stage-side cooling passage 70 cools the compressed gas supplied to the high-pressure-stage impeller 5 in the high-pressure-stage housing 7, so that the temperature rise of the compressed gas having passed through the high-pressure-stage impeller 5 can be suppressed. Thus, it is possible to improve the compression ratio in the high-pressure stage of the multi-stage electric centrifugal compressor 1. Further, when the temperature rise of the compressed gas having passed through the high-pressure-stage impeller 5 is suppressed, the temperature rise of gas in a space 24 facing the back surface 57 of the high-pressure-stage impeller 5 can be suppressed, so that the amount of heat input from the back surface 57 of the high-pressure-stage impeller 5 to the bearing 15 (e.g., high-pressure-stage-side grease-filled bearing 15B) can be reduced. This suppresses heat-induced deterioration of the bearing 15, thereby improving the life and durability of the bearing 15.

(Pressure-Relieving Hole)

In some embodiments, as shown in FIG. 8, the high-pressure-stage-side bearing housing 16B (bearing housing 16) has a first pressure-relieving hole 93. The first pressure-relieving hole 93 has a first inner opening 931 formed in the inner surface 165 of the high-pressure-stage-side bearing housing 16B that faces the outer peripheral surface of the rotating body 11 including the rotational shaft 3, and a first outer opening 932 formed in the outer surface 168 of the high-pressure-stage-side bearing housing 16B. The first inner opening 931 is formed between the high-pressure-stage-side grease-filled bearing 15B and the high-pressure-stage impeller 5 in the axial direction X of the rotational shaft 3.

As shown in FIG. 9, a space 24 is formed between the back surface 57 of the high-pressure-stage impeller 5 and a high-pressure-stage-side surface 167 of the high-pressure-stage-side bearing housing 16B that faces the back surface 57. Further, a gap 25 is formed between the outer peripheral surface 181 of the high-pressure-stage-side sleeve 18B and the inner surface 165 of the high-pressure-stage-side bearing housing 16B that faces the outer peripheral surface 181. The gap 25 communicates with the space 24.

In the illustrated embodiment, as shown in FIG. 9, the outer peripheral surface 181 of the high-pressure-stage-side sleeve 18B has a first annular groove in which a first seal member (e.g., annular seal ring) 22 is fitted, and a second annular groove 183 in which a second seal member (e.g., annular seal ring) 23 is fitted. The second annular groove 183 is formed on the low-pressure stage side XL (the right side in FIG. 9) of the first annular groove 182 in the axial direction X. The outer surfaces of the first seal member 22 and the second seal member 23 are in contact with the outer peripheral surface 181 of the high-pressure-stage-side sleeve 18B to divide the gap 25 into a plurality of sections. Further, in the illustrated embodiment, the first inner opening 931 is located in the axial direction X between the first annular groove 182 and the second annular groove 183.

When the high-pressure-stage impeller 5 rotates, the temperature and pressure of the gas in the space 24 rise. When the gas in the space 24 passes through the gap 25 and flows to the high-pressure-stage-side grease-filled bearing 15B, the high-pressure-stage-side grease-filled bearing 15B may deteriorate due to heat.

With the above configuration, the high-pressure-stage-side bearing housing 16B (bearing housing 16) has the first pressure-relieving hole 93 having the first inner opening 931 formed in the inner surface 165, and the first outer opening 932 formed in the outer surface 168. The first inner opening 931 is formed between the high-pressure-stage-side grease-filled bearing 15B and the high-pressure-stage impeller 5 in the axial direction of the rotational shaft 3. In this case, pressure leakage from the space 24 facing the back surface 57 of the high-pressure-stage impeller 5 can flow outside the high-pressure-stage-side bearing housing 16B (bearing housing 16) through the first pressure-relieving hole 93. In the illustrated example, the high-temperature and high-pressure gas leaked from the space 24 into the gap 25 between the first seal member 22 and the second seal member 23 is guided to the first pressure-relieving hole 93 through the first inner opening 931 and discharged out of the high-pressure-stage-side bearing housing 16B through the first outer opening 932 due to the pressure difference between the gas and the air outside the high-pressure-stage-side bearing housing 16B. In this case, it is possible to prevent pressure leakage from the space 24 facing the back surface 57 of the high-pressure-stage impeller 5 from flowing to the high-pressure-stage-side grease-filled bearing 15B. This suppresses heat-induced deterioration of the high-pressure-stage-side grease-filled bearing 15B, thereby improving the life and durability of the high-pressure-stage-side grease-filled bearing 15B.

The pressure-relieving hole may be formed on the low-pressure stage side. In some embodiments, as shown in FIG. 8, the low-pressure-stage-side bearing housing 16A (bearing housing 16) has a second pressure-relieving hole 94. The second pressure-relieving hole 94 has a second inner opening 941 formed in the inner surface 163 of the high-pressure-stage-side bearing housing 16B that faces the outer peripheral surface (in the illustrated example, the outer peripheral surface 184 of the low-pressure-stage-side sleeve 18A) of the rotating body 11 including the rotational shaft 3, and a second outer opening 942 formed in the outer surface 169 of the low-pressure-stage-side bearing housing 16A. The second inner opening 941 is formed between the low-pressure-stage-side grease-filled bearing 15A and the high-pressure-stage impeller 5 in the axial direction X of the rotational shaft 3. As with the first inner opening 931, the second inner opening 941 may be formed in the axial direction X between two seal members mounted on the low-pressure-stage-side sleeve 18A.

With the above configuration, the low-pressure-stage-side bearing housing 16A (bearing housing 16) has the second pressure-relieving hole 94 having the second inner opening 941 formed in the inner surface 163, and the second outer opening 942 formed in the outer surface 169. The second inner opening 941 is formed between the low-pressure-stage-side grease-filled bearing 15A and the low-pressure-stage impeller 4 in the axial direction of the rotational shaft 3. In this case, pressure leakage from the space facing the back surface of the low-pressure-stage impeller 4 can flow outside the low-pressure-stage-side bearing housing 16A (bearing housing 16) through the second pressure-relieving hole 94. In this case, it is possible to prevent pressure leakage from the space facing the back surface of the low-pressure-stage impeller 4 from flowing to the low-pressure-stage-side grease-filled bearing 15A. This suppresses heat-induced deterioration of the low-pressure-stage-side grease-filled bearing 15A, thereby improving the life and durability of the low-pressure-stage-side grease-filled bearing 15A.

In some embodiments, the suction may be forced through the first pressure-relieving hole 93 or the second pressure-relieving hole 94. For example, the multi-stage electric centrifugal compressor 1 may include a negative pressure source (not shown), and a pipe connecting at least one of the first pressure-relieving hole 93 or the second pressure-relieving hole 94 to the negative pressure source.

(Pressure-Applying Hole)

In some embodiments, as shown in FIG. 10, the high-pressure-stage-side bearing housing 16B (bearing housing 16) has a first pressure-applying hole 95. The first pressure-applying hole 95 has a third inner opening 951 formed in the inner surface 165 of the high-pressure-stage-side bearing housing 16B that faces the outer peripheral surface 181 of the rotating body 11 including the rotational shaft 3, and a third outer opening 952 formed in the outer surface 168 of the high-pressure-stage-side bearing housing 16B. The third inner opening 951 is formed between the high-pressure-stage-side grease-filled bearing 15B and the high-pressure-stage impeller 5 in the axial direction X of the rotational shaft 3. The multi-stage electric centrifugal compressor 1 includes a pressure inlet line 26 configured to introduce pressure from a pressure source (e.g., compressed gas supply line 21 or surge tank 27) to the third inner opening 951.

As shown in FIG. 11, a space 24 is formed between the back surface 57 of the high-pressure-stage impeller 5 and a high-pressure-stage-side surface 167 of the high-pressure-stage-side bearing housing 16B that faces the back surface 57. Further, a gap 25 is formed between the outer peripheral surface 181 of the high-pressure-stage-side sleeve 18B and the inner surface 165 of the high-pressure-stage-side bearing housing 16B that faces the outer peripheral surface 181. The gap 25 communicates with the space 24.

In the illustrated embodiment, as shown in FIG. 11, the outer peripheral surface 181 of the high-pressure-stage-side sleeve 18B has a first annular groove in which a first seal member (e.g., annular seal ring) 22 is fitted, and a second annular groove 183 in which a second seal member (e.g., annular seal ring) 23 is fitted. The second annular groove 183 is formed on the low-pressure stage side XL (the right side in FIG. 11) of the first annular groove 182 in the axial direction X. The outer surfaces of the first seal member 22 and the second seal member 23 are in contact with the outer peripheral surface 181 of the high-pressure-stage-side sleeve 18B to divide the gap 25 into a plurality of sections. Further, in the illustrated embodiment, the third inner opening 951 is located in the axial direction X between the first annular groove 182 and the second annular groove 183.

In the illustrated embodiment, the pressure inlet line 26 is configured to introduce pressure from each of the compressed gas supply line 21 and the surge tank 27 to the third outer opening 952. The gas in the surge tank 27 has a higher pressure than the space 24 due to a compressor 28. The pressure inlet line 26 includes a first pipe 261 connected at one end to a branch portion 211 of the compressed gas supply line 21 and at the other end to the third outer opening, a second pipe 262 connected at one end to the first pipe 261 and at the other end to the surge tank 27, and a switching device 263 configured to switch the source of pressure to the third outer opening 952 to either the compressed gas supply line 21 or the surge tank 27. The switching device 263 may be a three-way valve disposed at the connection between the first pipe 261 and the second pipe 262, as shown in FIG. 10, or may be valves (e.g., open/close valve) disposed upstream of the connection between the first pipe 261 and the second pipe 262 and on the second pipe 262. In other embodiments, the pressure inlet line 26 may include a pipe connected at one end to the surge tank 27 and at the other end to the third outer opening and may be configured to introduce pressure from only the surge tank 27 to the third outer opening 952. By introducing pressure from the compressed gas supply line 21 to the third outer opening 952, the capacity of the surge tank 27 can be reduced.

As described above, when the high-pressure-stage impeller 5 rotates, the temperature and pressure of the gas in the space 24 rise. When the gas in the space 24 passes through the gap 25 and flows to the high-pressure-stage-side grease-filled bearing 15B, the high-pressure-stage-side grease-filled bearing 15B may deteriorate due to heat.

With the above configuration, the high-pressure-stage-side bearing housing 16B (bearing housing 16) has the first pressure-applying hole 95 having the third inner opening 951 formed in the inner surface 165, and the third outer opening 952 formed in the outer surface 168. The third inner opening 951 is formed between the high-pressure-stage-side grease-filled bearing 15B and the high-pressure-stage impeller 5 in the axial direction of the rotational shaft 3. The multi-stage electric centrifugal compressor 1 includes the pressure inlet line 26. In this case, by introducing pressure from the pressure source to the third outer opening 952 through the pressure inlet line 26, the pressure in the gap 25 formed between the outer peripheral surface 181 and the 165 can be raised higher than the pressure in the space 24 facing the back surface 57 of the high-pressure-stage impeller 5. When the pressure in the gap 25 is higher than the pressure in the space 24, it is possible to prevent pressure leakage from the space 24 facing the back surface 57 of the high-pressure-stage impeller 5. This suppresses heat-induced deterioration of the high-pressure-stage-side grease-filled bearing 15B, thereby improving the life and durability of the high-pressure-stage-side grease-filled bearing 15B.

Further, when the pressure in the gap 25 is higher than the pressure in the space accommodating the high-pressure-stage-side grease-filled bearing 15B, grease filled in the high-pressure-stage-side grease-filled bearing 15B is prevented from leaking through the gap and the space 24 into the flow path through which the compressed gas flows. This prevents grease from mixing with the compressed gas compressed by the multi-stage electric centrifugal compressor 1, so that the multi-stage electric centrifugal compressor 1 can supply clean compressed gas to the fuel cell 20 or the like.

In the illustrated embodiment, as shown in FIG. 10, the high-pressure-stage-side bearing housing 16B (bearing housing 16) further has a third pressure-relieving hole 96. The third pressure-relieving hole 96 has an inner opening 961 formed in the bearing support surface 162 on the high-pressure stage side (the left side in the figure) of the high-pressure-stage-side grease-filled bearing 15B, and an outer opening 962 formed in the outer surface 168 of the high-pressure-stage-side bearing housing 16B. The inner opening 961 faces the space formed between the high-pressure-stage-side sleeve 18B and the high-pressure-stage-side grease-filled bearing 15B. With the above configuration, the high-pressure gas leaked from the gap 25 between the first seal member 22 and the second seal member 23 into the space between the high-pressure-stage-side sleeve 18B and the high-pressure-stage-side grease-filled bearing 15B can be guided to the third pressure-relieving hole 96 through the inner opening 961 and discharged out of the high-pressure-stage-side bearing housing 16B through the outer opening 962 due to the pressure difference between the gas and the air outside the high-pressure-stage-side bearing housing 16B. In this case, it is possible to prevent pressure leakage from the gap from flowing to the high-pressure-stage-side grease-filled bearing 15B.

The pressure-applying hole may be formed on the low-pressure stage side. In some embodiments, as shown in FIG. 10, the low-pressure-stage-side bearing housing 16A (bearing housing 16) has a second pressure-applying hole 97. The second pressure-applying hole 97 has an inner opening 971 formed in the inner surface 163 of the high-pressure-stage-side bearing housing 16B that faces the outer peripheral surface (in the illustrated example, the outer peripheral surface 184 of the low-pressure-stage-side sleeve 18A) of the rotating body 11 including the rotational shaft 3, and an outer opening 972 formed in the outer surface 169 of the low-pressure-stage-side bearing housing 16A. The inner opening 971 is formed between the low-pressure-stage-side grease-filled bearing 15A and the low-pressure-stage impeller 4 in the axial direction X of the rotational shaft 3. As with the third inner opening 951, the inner opening 971 may be formed in the axial direction X between two seal members mounted on the low-pressure-stage-side sleeve 18A.

Additionally, the multi-stage electric centrifugal compressor 1 further includes a pressure inlet line 29 configured to introduce pressure from a pressure source (e.g., compressed gas supply line 21 or surge tank 27) to the outer opening 972. In the illustrated embodiment, the pressure inlet line 29 shares some equipment (pipes and valves) with the pressure inlet line 26. That is, the pressure inlet line 29 has a third pipe 291 connected at one end to a branch portion 264 of the first pipe 261 between the connection with the second pipe 262 and the third outer opening 952 and at the other end to the outer opening 972, and a pressure reducing valve 292 disposed on the third pipe 291. In some embodiments, the pressure inlet line 29 may share no equipment with the pressure inlet line 26.

With the above configuration, the low-pressure-stage-side bearing housing 16A (bearing housing 16) has the second pressure-applying hole 97 having the inner opening 971 formed in the inner surface 163, and the outer opening 972 formed in the outer surface 169. The inner opening 971 is formed between the low-pressure-stage-side grease-filled bearing 15A and the low-pressure-stage impeller 4 in the axial direction of the rotational shaft 3. The multi-stage electric centrifugal compressor 1 includes the pressure inlet line 29. In this case, by introducing pressure from the pressure source to the outer opening 972 through the pressure inlet line 29, the pressure in the gap facing the inner surface 163 can be raised higher than the pressure in the space facing the back surface of the low-pressure-stage impeller. Thus, it is possible to prevent pressure leakage from the space facing the back surface of the low-pressure-stage impeller, and to improve the life and durability of the high-pressure-stage-side grease-filled bearing 15B.

Further, when the pressure in the gap facing the inner surface 163 is higher than the pressure in the space accommodating the low-pressure-stage-side grease-filled bearing 15A, grease filled in the low-pressure-stage-side grease-filled bearing 15A is prevented from leaking into the flow path through which the compressed gas flows. This prevents grease from mixing with the compressed gas compressed by the multi-stage electric centrifugal compressor 1, so that the multi-stage electric centrifugal compressor 1 can supply clean compressed gas to the fuel cell 20 or the like.

In the illustrated embodiment, as shown in FIG. 11, the low-pressure-stage-side bearing housing 16A (bearing housing 16) further has a fourth pressure-relieving hole 98. The fourth pressure-relieving hole 98 has an inner opening 981 formed in the bearing support surface 161 on the low-pressure stage side (the right side in the figure) of the low-pressure-stage-side grease-filled bearing 15A, and an outer opening 982 formed in the outer surface 169 of the low-pressure-stage-side bearing housing 16A. The inner opening 981 faces the space formed between the low-pressure-stage-side sleeve 18A and the low-pressure-stage-side grease-filled bearing 15A. With the above configuration, the high-pressure gas leaked from the gap facing the inner surface 163 into the space between the low-pressure-stage-side sleeve 18A and the low-pressure-stage-side grease-filled bearing 15A can be guided to the fourth pressure-relieving hole 98 through the inner opening 981 and discharged out of the low-pressure-stage-side bearing housing 16A through the outer opening 982 due to the pressure difference between the gas and the air outside the low-pressure-stage-side bearing housing 16A. In this case, it is possible to prevent pressure leakage from the gap facing the inner surface 163 from flowing to the low-pressure-stage-side grease-filled bearing 15A.

(Air Cooling Mechanism of Electric Motor)

Figure 12:
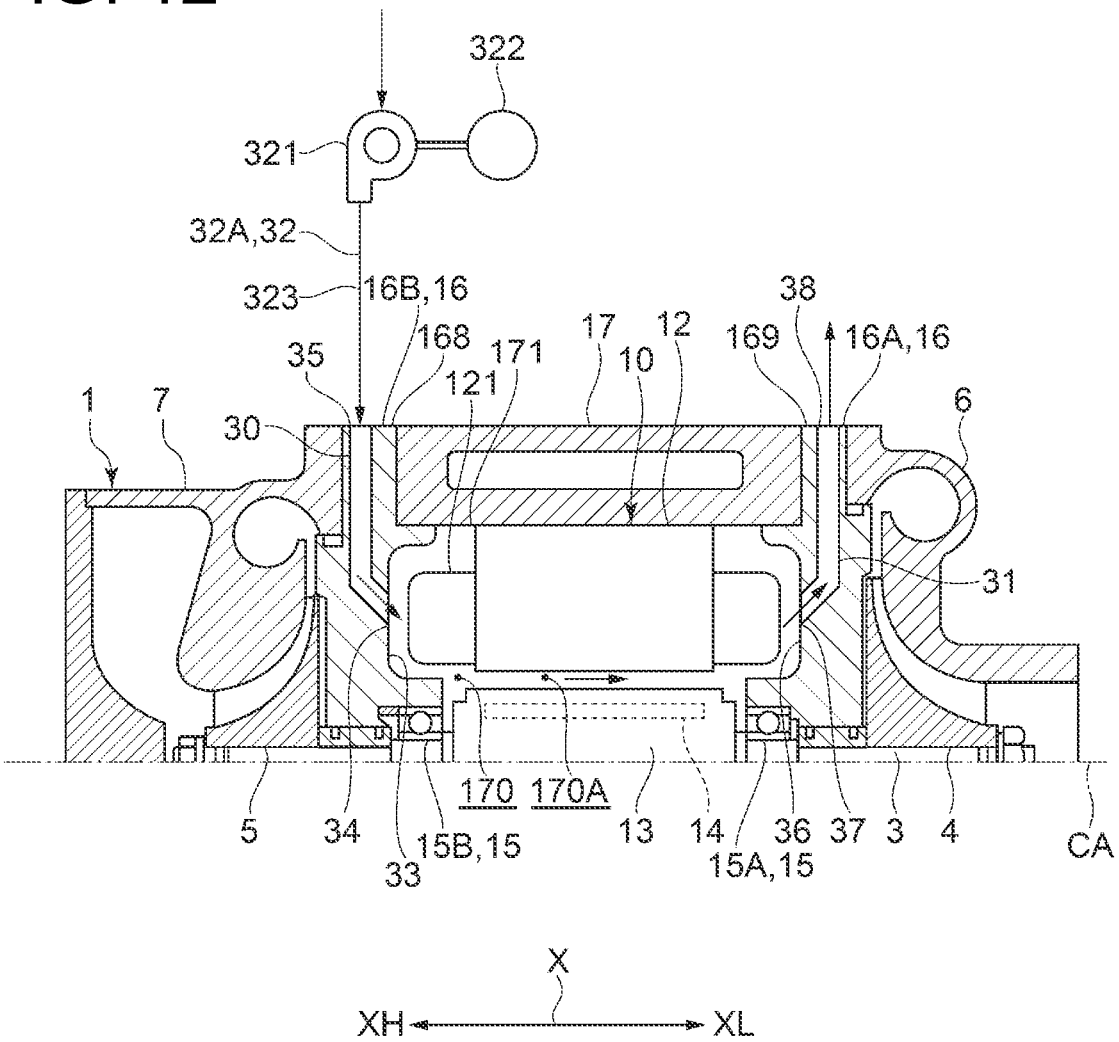
FIG. 12 is a schematic configuration diagram schematically showing a configuration of a multi-stage electric centrifugal compressor according to an embodiment of the present disclosure.
Figure 13:
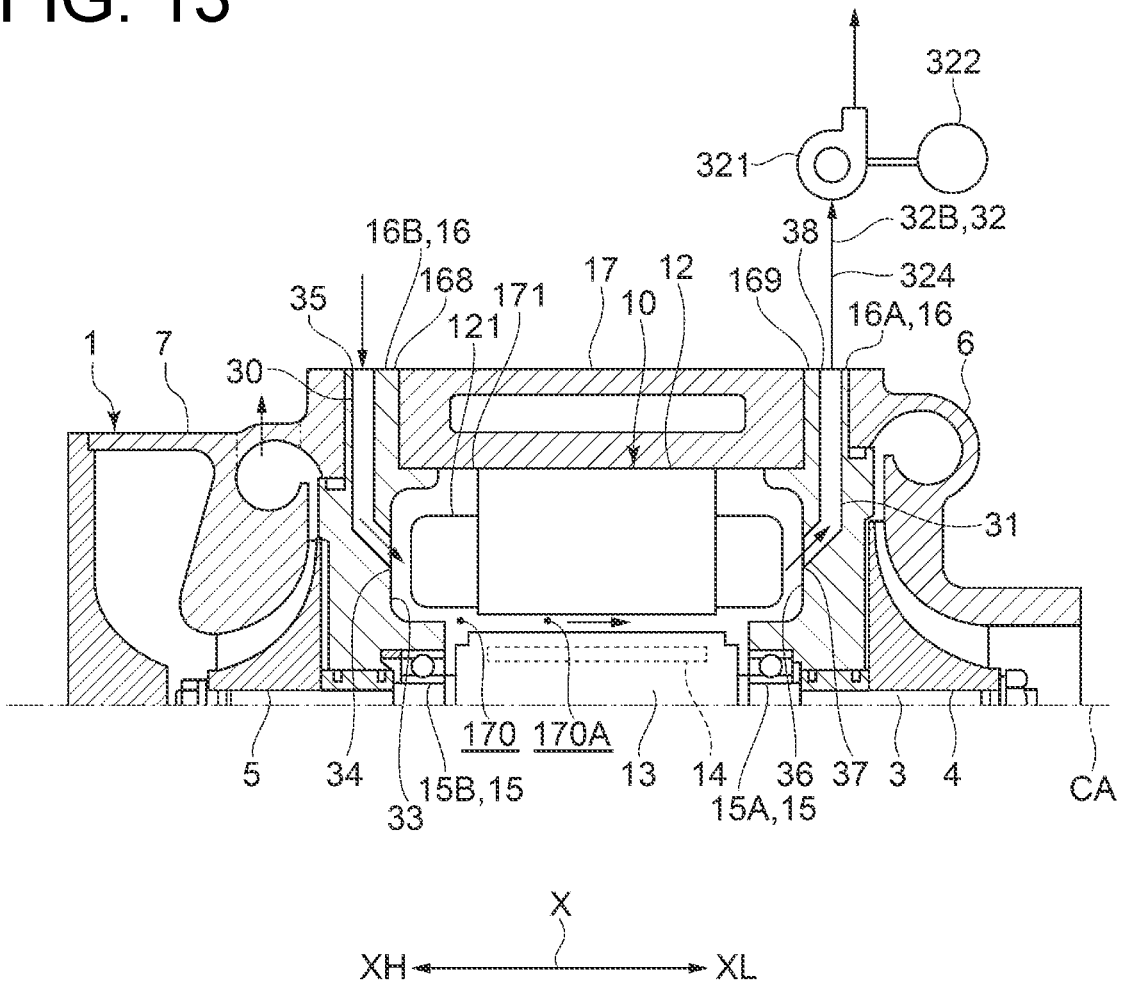
FIG. 13 is a schematic configuration diagram schematically showing a configuration of a multi-stage electric centrifugal compressor according to an embodiment of the present disclosure.

FIGS. 12 and 13 are each a schematic configuration diagram schematically showing a configuration of a multi-stage electric centrifugal compressor according to an embodiment of the present disclosure. FIGS. 12 and 13 schematically show a cross-section (semi-cross-section) of the multi-stage electric centrifugal compressor 1 on one side of the axis CA, in a cross-section taken along the axis CA of the rotational shaft 3.

In some embodiments, as shown in FIGS. 12 and 13, the stator housing 17 has an inner surface (inner peripheral surface) 171 that forms a motor accommodating portion 170 accommodating the electric motor 10 (motor stator 12 and rotor assembly 13). The bearing housing 16 has an air inlet hole 30 for supplying air to the motor accommodating portion 170, and an air exhaust hole 31 for discharging the air from the motor accommodating portion 170 to the outside of the bearing housing 16. The multi-stage electric centrifugal compressor 1 further includes an air inlet line 32 configured to supply air to the air inlet hole 30 or to suck air from the air exhaust hole 31.

The air inlet hole 30 has a fourth inner opening 34 formed in the inner surface 33 of the bearing housing 16 that faces the motor accommodating portion 170, and a fourth outer opening 35 formed in the outer surface 168 of the bearing housing 16. The air exhaust hole 31 has a fifth inner opening 37 formed in the inner surface 36 of the bearing housing 16 that faces the motor accommodating portion 170, and a fifth outer opening 38 formed in the outer surface 169 of the bearing housing 16. The inner surface 36 having the fifth inner opening 37 is located on the opposite side of the electric motor 10 from the inner surface 33 having the fourth inner opening 34 in the axial direction of the rotational shaft 3. The fourth inner opening 34 is formed on one side (the high-pressure stage side XH in the illustrated example) of the electric motor 10 in the axial direction X of the rotational shaft 3, and the fifth inner opening 37 is formed on the other side (the low-pressure stage side XL in the illustrated example) of the electric motor 10 in the axial direction X of the rotational shaft 3. In the illustrated example, each of the inner surfaces 33 and 36 extends along the radial direction.

In the illustrated embodiment, the air inlet hole 30 is formed in the high-pressure-stage-side bearing housing 16B, and the air exhaust hole 31 is formed in the low-pressure-stage-side bearing housing 16A. The motor stator 12 supported by the stator housing 17 in the motor accommodating portion 170 has a gap 170A between the motor stator 12 and the rotor assembly 13. The motor accommodating portion 170 includes the gap 170A. Further, the multi-stage electric centrifugal compressor 1 includes a gas compressor 321 (e.g., electric fan) configured to blow air from the inlet side to the outlet side, and a power supply source 322 configured to supply power to the gas compressor 321. The gas compressor 321 blows air from the inlet side to the outlet side by, for example, rotating a rotary fan with a fan motor driven by power supplied from the power supply source 322.

In the embodiment shown in FIG. 12, the air inlet line 32 (32A) is configured to supply air to the air inlet hole 30. As shown in FIG. 12, the air inlet line 32 (32A) includes a gas passage 323, through which air for cooling the motor accommodating portion 170 flows, connected at one end to the outlet side of the gas compressor 321 and at the other end to the fourth outer opening 35.

In this case, by driving the gas compressor 321, the air introduced from the inlet side of the gas compressor 321 is guided from one side to the other side of the gas passage 323 and then supplied to the motor accommodating portion 170 through the air inlet hole 30. The air supplied to the motor accommodating portion 170 flows through the motor accommodating portion 170 from the high-pressure stage side XH to the low-pressure stage side XL, passes through the gap 170A, and is then discharged to the outside of the bearing housing 16 through the air exhaust hole 31. The air discharged from the fifth outer opening 38 of the air exhaust hole 31 to the outside of the bearing housing 16 may be released to the atmosphere.

In the embodiment shown in FIG. 13, the air inlet line 32 (32B) is configured to suck air from the air exhaust hole 31. As shown in FIG. 13, the air inlet line 32 (32B) includes a gas passage 324, through which air for cooling the motor accommodating portion 170 flows, connected at one end to the inlet side of the gas compressor 321 and at the other end to the fifth outer opening 38.

In this case, by driving the gas compressor 321, the air outside the bearing housing 16 is sucked into the air inlet hole 30 through the fourth outer opening 35. The air sucked into the air inlet hole 30 is supplied to the motor accommodating portion 170 by the suction force of the gas compressor 321, flows through the motor accommodating portion 170 from the high-pressure stage side XH to the low-pressure stage side XL, passes through the gap 170A, and is then discharged to the outside of the bearing housing 16 through the air exhaust hole 31.

With the above configuration, the air is forcibly introduced from the fourth outer opening 35 through the air inlet hole 30 to the motor accommodating portion 170 by the air inlet line 32. Further, the air is forcibly discharged from the motor accommodating portion 170 through the air exhaust hole 31 to the outside of the bearing housing 16 by the air inlet line 32. The fifth inner opening 37 of the air exhaust hole 31 is located on the opposite side of the electric motor 10 from the fourth inner opening 34 of the air inlet hole 30 in the axial direction of the rotational shaft 3. Thus, the air can be forcibly blown from one side to the other side of the motor accommodating portion 170. The electric motor 10 accommodated in the motor accommodating portion 170 is cooled (air-cooled) by dissipating heat through heat exchange with air. By cooling the rotor assembly 13 and a motor coil 121 of the electric motor 10, which is the heat source, with the air, the temperature rise of the bearing 15 (e.g., high-pressure-stage-side grease-filled bearing 15B) can be suppressed. This suppresses heat-induced deterioration of the bearing 15, thereby improving the life and durability of the bearing 15.

In the above-described embodiment, the air inlet hole 30 is formed in the high-pressure-stage-side bearing housing 16B, and the air exhaust hole 31 is formed in the low-pressure-stage-side bearing housing 16A, but the air inlet hole 30 may be formed in the low-pressure-stage-side bearing housing 16A, and the air exhaust hole 31 may be formed in the high-pressure-stage-side bearing housing 16B. Since the high-pressure-stage-side bearing housing 16B is more affected by heat than the low-pressure-stage-side bearing housing 16A, it is necessary to effectively cool the high-pressure stage side XH. Therefore, it is preferable to form the air inlet hole 30 in the high-pressure-stage-side bearing housing 16B so that the upstream side in the flow direction of the air for cooling the electric motor 10 is the high-pressure stage side XH.

The present disclosure is not limited to the embodiments described above, but includes modifications to the embodiments described above, and embodiments composed of combinations of those embodiments.

The contents described in the above embodiments would be understood as follows, for instance.

1) A multi-stage centrifugal compressor (1) according to at least one embodiment of the present disclosure is a multi-stage electric centrifugal compressor (1) configured to drive impellers (low-pressure-stage impeller 4 and high-pressure-stage impeller 5) disposed at both ends of a rotational shaft (3) by an electric motor (10), comprising: the rotational shaft (3); a low-pressure-stage impeller (4) disposed at one end of the rotational shaft (3); a high-pressure-stage impeller (5) disposed at the other end of the rotational shaft (3); a high-pressure-stage housing (7) accommodating the high-pressure-stage impeller (5); and a connecting pipe (8) for supplying a compressed gas compressed by the low-pressure-stage impeller (4) to the high-pressure-stage housing (7). The high-pressure-stage housing (7) has a high-pressure-stage inlet opening (71) that opens in a direction intersecting an axis (CA) of the rotational shaft (3). The connecting pipe (8) includes a high-pressure-stage-side connection portion (81) connected to the high-pressure-stage inlet opening (71).

With the above configuration 1), the high-pressure-stage housing (7) has the high-pressure-stage inlet opening (71) that opens in a direction intersecting the axis (CA) of the rotational shaft (3), and the high-pressure-stage-side connection portion (81) of the connecting pipe (8) is connected to the high-pressure-stage inlet opening (71). Accordingly, the compressed gas pressurized by the low-pressure-stage impeller (4) is supplied from the outer peripheral side of the high-pressure-stage housing (7) into the high-pressure-stage housing (7) through the connecting pipe (8). In this case, as compared to the case where the compressed gas is introduced into the high-pressure-stage housing (7) along the axial direction of the rotational shaft (3), the length of the connecting pipe (8) and the high-pressure-stage housing (7) in the axial direction can be shortened. As a result, the length of the multi-stage electric centrifugal compressor (1) in the axial direction can be shortened, so that the size and weight of the multi-stage electric centrifugal compressor (1) can be reduced.

2) In some embodiments, in the multi-stage electric centrifugal compressor (1) described in the above 1), a flow path cross-section of the high-pressure-stage-side connection portion (81) has a longitudinal direction (LD) along a direction perpendicular to the axis (CA) of the rotational shaft (3), and includes convexly curved portions (811, 812) formed at both ends in the longitudinal direction (LD).

With the above configuration 2), the flow path cross-section of the high-pressure-stage-side connection portion (81) has the longitudinal direction (LD) along the direction perpendicular to the axis (CA) of the rotational shaft (3), and includes the convexly curved portions (811, 812) formed at both ends in the longitudinal direction (LD). In this case, since the high-pressure-stage-side connection portion (81) has an oval flow path cross-section extending along the longitudinal direction (LD), the flow path area of the high-pressure-stage-side connection portion (81) can be increased while preventing the high-pressure-stage-side connection portion (81) from becoming large in the axial direction of the rotational shaft (3). By increasing the flow path area of the high-pressure-stage-side connection portion (81), a necessary amount of the compressed gas can be supplied to the high-pressure-stage housing (7). Further, since the high-pressure-stage-side connection portion (81) has an oval flow path cross-section, the pressure loss of the compressed gas flowing through the high-pressure-stage-side connection portion (81) can be suppressed.

3) In some embodiments, in the multi-stage electric centrifugal compressor (1) described in the above 2), the flow path cross-section of the high-pressure-stage-side connection portion (81) has a transverse direction (SD) along the axis (CA) of the rotational shaft (3).

With the above configuration 3), since the flow path cross-section of the high-pressure-stage-side connection portion (81) has the transverse direction (SD) along the axis (CA), the length of the high-pressure-stage-side connection portion (81) in the axial direction of the rotational shaft (3) can be shortened, so that the size and weight of the multi-stage electric centrifugal compressor (1) can be reduced.

4) In some embodiments, in the multi-stage electric centrifugal compressor (1) described in the above 2) or 3), the flow path cross-section of the high-pressure-stage-side connection portion (81) is formed such that a length in the longitudinal direction increases toward the high-pressure-stage inlet opening (71).

With the above configuration 4), since the flow path cross-section of the high-pressure-stage-side connection portion (81) is formed such that the length in the longitudinal direction increases toward the high-pressure-stage inlet opening (71), the compressed gas flowing along the inner wall surface (810) of the high-pressure-stage-side connection portion (81) can still flow along an inner wall surface (77) that defines the supply passage (73) of the high-pressure-stage housing (7). By flowing the compressed gas along the inner wall surface (77) of the high-pressure-stage housing (7), the separation of the compressed gas from the inner wall surface (77) can be suppressed, so that the pressure loss of the compressed gas in the supply passage (73) of the high-pressure-stage housing (7) can be reduced.

5) In some embodiments, in the multi-stage electric centrifugal compressor (1) described in the above 4), the flow path cross-section of the high-pressure-stage-side connection portion (81) is formed such that a maximum curvature of the convexly curved portions (811, 812) increases toward the high-pressure-stage inlet opening (71).

With the above configuration 5), since the flow path cross-section of the high-pressure-stage-side connection portion (81) is formed such that the maximum curvature of the convexly curved portions (811, 812) increases toward the high-pressure-stage inlet opening (71), the compressed gas flowing through the high-pressure-stage-side connection portion (81) can be smoothly guided to the high-pressure-stage inlet opening (71). Thus, it is possible to reduce the pressure loss of the compressed gas at the connection between the high-pressure-stage-side connection portion (81) and the high-pressure-stage inlet opening (71).

6) In some embodiments, the multi-stage electric centrifugal compressor (1) described in any one of the above 2) to 5) comprises a low-pressure-stage housing (6) accommodating the low-pressure-stage impeller (4). The low-pressure-stage housing (6) has a low-pressure-stage outlet opening (62) that opens in a direction intersecting the axis (CA) of the rotational shaft (3). The connecting pipe (8) includes: a low-pressure-stage-side connection portion (82) connected to the low-pressure-stage outlet opening (62); an intermediate portion (83) extending along the axis (CA) of the rotational shaft (3); a low-pressure-stage-side curved portion (84) having a curved shape that connects the low-pressure-stage-side connection portion (82) and the intermediate portion (83); and a high-pressure-stage-side curved portion (85) having a curved shape that connects the high-pressure-stage-side connection portion (81) and the intermediate portion (83). At least a flow path cross-section of the low-pressure-stage-side connection portion (82) is formed in a circular shape.

With the above configuration 6), since at least the low-pressure-stage-side connection portion (82) of the connecting pipe (8) has a circular flow path cross-section, the pressure loss of the compressed gas having a swirl component flowing through the connecting pipe (8) can be reduced.

7) In some embodiments, the multi-stage electric centrifugal compressor (1) described in any one of the above 2) to 6) further comprises a cooling device (86) configured to perform heat exchange between the compressed gas in the connecting pipe (8) and a cooling liquid for cooling the compressed gas.

With the above configuration 7), the compressed gas flowing through the connecting pipe (8) is cooled by the heat exchange between the compressed gas in the connecting pipe (8) and the cooling liquid in the cooling device (86). By cooling the compressed gas sent to the high-pressure-stage impeller (5), the temperature rise of the compressed gas having passed through the high-pressure-stage impeller (5) can be suppressed. Thus, it is possible to improve the compression ratio in the high-pressure stage of the multi-stage electric centrifugal compressor (1). Further, when the temperature rise of the compressed gas having passed through the high-pressure-stage impeller (5) is suppressed, the temperature rise of gas in a space (24) facing the back surface (57) of the high-pressure-stage impeller (5) can be suppressed, so that the amount of heat input from the back surface (57) of the high-pressure-stage impeller (5) to the bearing (15, particularly, high-pressure-stage-side grease-filled bearing 15B) can be reduced. This suppresses heat-induced deterioration of the bearing (15), thereby improving the life and durability of the bearing (15).

8) In some embodiments, in the multi-stage electric centrifugal compressor (1) described in any one of the above 1) to 7), the high-pressure-stage housing (7) includes: an inner wall surface (77) that defines a supply passage (73) for leading the compressed gas supplied from the high-pressure-stage inlet opening (71) to the high-pressure-stage impeller (5), the inner wall surface (77) including an inner end wall surface (771) that defines a side of the supply passage (73) opposite to the high-pressure-stage impeller (5) and an inner peripheral wall surface (772) that defines an outer peripheral side of the supply passage; and a guide protruding portion (78) that protrudes from the inner end wall surface (771) toward the high-pressure-stage impeller (5).

With the above configuration 8), the guide protruding portion (78) that protrudes from the inner end wall surface (771) toward the high-pressure-stage impeller (5) guides the compressed gas flowing through the supply passage (73) of the high-pressure-stage housing (7) to the high-pressure-stage impeller (5). In this case, since the guide protruding portion (78) allows the compressed gas to be led to the high-pressure-stage impeller (5) along the axial direction, as compared to the case where the compressed gas is led to the high-pressure-stage impeller (5) from the outer side in the radial direction, the efficiency of the multi-stage electric centrifugal compressor (1) can be improved.

9) In some embodiments, in the multi-stage electric centrifugal compressor (1) described in the above 8), the inner peripheral wall surface (772) has an inlet-side inner peripheral wall surface (773) formed with the high-pressure-stage inlet opening (71), and an opposite-side inner peripheral wall surface (774) disposed opposite to the high-pressure-stage inlet opening (71). The high-pressure-stage housing (7) includes an anti-swirl plate (79) that protrudes from the opposite-side inner peripheral wall surface (774).

With the above configuration 9), the anti-swirl plate (79) can suppress the collision between the compressed gas flowing through the supply passage (73) of the high-pressure-stage housing (7) in one direction in the circumferential direction of the rotational shaft (3) and the compressed gas flowing through the supply passage (73) in the opposite direction to the one direction in the circumferential direction. Further, the anti-swirl plate (79) guides the compressed gas flowing along the opposite-side inner peripheral wall surface (774) to the inner side in the radial direction where the high-pressure-stage impeller (5) is located, thereby smoothly guiding the compressed gas flowing from the high-pressure-stage inlet opening (71) to the high-pressure-stage impeller (5). Thus, it is possible to reduce the pressure loss of the compressed gas in the supply passage (73) of the high-pressure-stage housing (7).

10) In some embodiments, in the multi-stage electric centrifugal compressor (1) described in the above 9), a tip (791) of the anti-swirl plate (79) is located on a further outer peripheral side of the rotational shaft (3) than a tip end (56) of a leading edge (55) of the high-pressure-stage impeller (5).

If the tip (791) of the anti-swirl plate (79) is located on a further inner peripheral side of the rotational shaft (3) than the tip end (56) of the leading edge (55) of the high-pressure-stage impeller (5), the compressed gas guided by the anti-swirl plate (79) and led to the high-pressure-stage impeller (5) has a strong radially inward velocity component, which may reduce the compression efficiency of the high-pressure-stage impeller (5). With the above configuration 10), since the tip (791) of the anti-swirl plate (79) is located on a further outer peripheral side of the rotational shaft (3) than the tip end (56) of the leading edge (55) of the high-pressure-stage impeller (5), the compressed gas guided by the anti-swirl plate (79) and led to the high-pressure-stage impeller (5) has a smaller radially inward velocity component. Thus, it is possible to suppress the decrease in the compression efficiency in the high-pressure-stage impeller (5).

11) In some embodiments, the multi-stage electric centrifugal compressor (1) described in any one of the above 1) to 10) comprises: at least one bearing (15) rotatably supporting the rotational shaft (3) and disposed between the high-pressure-stage impeller (5) and the low-pressure-stage impeller (4); and a bearing housing (16) accommodating the at least one bearing (15). The at least one bearing (15) includes a high-pressure-stage-side grease-filled bearing (15B) disposed between the high-pressure-stage impeller (5) and the electric motor (10). The bearing housing (16) has a cooling passage (91) formed between the high-pressure-stage-side grease-filled bearing (15B) and the high-pressure-stage impeller (5) in an axial direction of the rotational shaft (3).

With the above configuration 11), the multi-stage electric centrifugal compressor (1) includes the high-pressure-stage-side grease-filled bearing (15B) in which grease is previously packed. In this case, since it is not necessary to supply grease to the high-pressure-stage-side grease-filled bearing (15B), the structure of parts (e.g., high-pressure-stage-side bearing housing 16B) around the high-pressure-stage-side grease-filled bearing (15B) can be simplified, so that the size and weight of the multi-stage electric centrifugal compressor (1) can be reduced.

With the above configuration 11), the bearing housing (16) has the cooling passage (91) formed between the high-pressure-stage-side grease-filled bearing (15B) and the high-pressure-stage impeller (5) in the axial direction of the rotational shaft (3). Thus, the cooling passage (91) can suppress the heat transfer from the back surface (57) of the high-pressure-stage impeller (5) to the high-pressure-stage-side grease-filled bearing (15B). This suppresses heat-induced deterioration of the high-pressure-stage-side grease-filled bearing (15B), thereby improving the life and durability of the high-pressure-stage-side grease-filled bearing (15B).

12) In some embodiments, in the multi-stage electric centrifugal compressor (1) described in any one of the above 1) to 11), the high-pressure-stage housing (7) has a high-pressure-stage-side cooling passage (70) formed on a further outer peripheral side of the rotational shaft (3) than the high-pressure-stage impeller (5).

With the above configuration 12), the high-pressure-stage-side cooling passage (70) cools the compressed gas supplied to the high-pressure-stage impeller (5) in the high-pressure-stage housing (7), so that the temperature rise of the compressed gas having passed through the high-pressure-stage impeller (5) can be suppressed. Thus, it is possible to improve the compression ratio in the high-pressure stage of the multi-stage electric centrifugal compressor (1). Further, when the temperature rise of the compressed gas having passed through the high-pressure-stage impeller (5) is suppressed, the temperature rise of gas in a space (24) facing the back surface (57) of the high-pressure-stage impeller (5) can be suppressed, so that the amount of heat input from the back surface (57) of the high-pressure-stage impeller (5) to the bearing (15, high-pressure-stage-side grease-filled bearing 15B) can be reduced. This suppresses heat-induced deterioration of the bearing (15), thereby improving the life and durability of the bearing (15).

13) In some embodiments, the multi-stage electric centrifugal compressor (1) described in any one of the above 1) to 12) comprises: at least one bearing (15) rotatably supporting the rotational shaft (3) and disposed between the high-pressure-stage impeller (5) and the low-pressure-stage impeller (4); and a bearing housing (16) accommodating the at least one bearing (15). The at least one bearing (15) includes a high-pressure-stage-side grease-filled bearing (15B) disposed between the high-pressure-stage impeller (5) and the electric motor (10). The bearing housing (16) has a first pressure-relieving hole (93) having a first inner opening (931) formed in an inner surface (165) of the bearing housing (16) that faces an outer peripheral surface (181) of a rotating body (11) including the rotational shaft (3), and a first outer opening (932) formed in an outer surface (168) of the bearing housing (16), the first inner opening (931) being formed between the high-pressure-stage-side grease-filled bearing (15B) and the high-pressure-stage impeller (5) in an axial direction of the rotational shaft (3).

With the above configuration 13), the bearing housing (16) has the first pressure-relieving hole (93) having the first inner opening (931) formed in the inner surface (165), and the first outer opening (932) formed in the outer surface (168). The first inner opening (931) is formed between the high-pressure-stage-side grease-filled bearing (15B) and the high-pressure-stage impeller (5) in the axial direction of the rotational shaft (3). In this case, it is possible to prevent pressure leakage from the space (24) facing the back surface (57) of the high-pressure-stage impeller (5) from flowing to the high-pressure-stage-side grease-filled bearing (15B). This suppresses heat-induced deterioration of the high-pressure-stage-side grease-filled bearing (15B), thereby improving the life and durability of the high-pressure-stage-side grease-filled bearing (15B).

14) In some embodiments, in the multi-stage electric centrifugal compressor (1) described in the above 13), the at least one bearing (15) further includes a low-pressure-stage-side grease-filled bearing (15A) disposed between the low-pressure-stage impeller (4) and the electric motor (10). The bearing housing (16) has a second pressure-relieving hole (94) having a second inner opening (941) formed in an inner surface (163) of the bearing housing (16) that faces an outer peripheral surface (184) of a rotating body (11) including the rotational shaft (3), and a second outer opening (942) formed in an outer surface (169) of the bearing housing (16), the second inner opening (941) being formed between the low-pressure-stage-side grease-filled bearing (15A) and the low-pressure-stage impeller (4) in the axial direction of the rotational shaft (3).

With the above configuration 14), the multi-stage electric centrifugal compressor (1) includes the low-pressure-stage-side grease-filled bearing (15A) in which grease is previously packed. In this case, since it is not necessary to supply grease to the low-pressure-stage-side grease-filled bearing (15A), the structure of parts (e.g., low-pressure-stage-side bearing housing 16A) around the low-pressure-stage-side grease-filled bearing (15A) can be simplified, so that the size and weight of the multi-stage electric centrifugal compressor (1) can be reduced.

With the above configuration 14), the bearing housing (16) has the second pressure-relieving hole (94) having the second inner opening (941) formed in the inner surface (163), and the second outer opening (942) formed in the outer surface (169). The second inner opening (163) is formed between the low-pressure-stage-side grease-filled bearing (15A) and the low-pressure-stage impeller (4) in the axial direction of the rotational shaft (3). In this case, pressure leakage from the space facing the back surface of the low-pressure-stage impeller (4) can flow outside the bearing housing (16) through the second pressure-relieving hole (94). In this case, it is possible to prevent pressure leakage from the space facing the back surface of the low-pressure-stage impeller (4) from flowing to the low-pressure-stage-side grease-filled bearing (15A). This suppresses heat-induced deterioration of the low-pressure-stage-side grease-filled bearing (15A), thereby improving the life and durability of the low-pressure-stage-side grease-filled bearing (15A).

15) In some embodiments, the multi-stage electric centrifugal compressor (1) described in any one of the above 1) to 12) comprises: at least one bearing (15) rotatably supporting the rotational shaft (3) and disposed between the high-pressure-stage impeller (5) and the low-pressure-stage impeller (4); and a bearing housing (16) accommodating the at least one bearing (15). The at least one bearing (15) includes a high-pressure-stage-side grease-filled bearing (15B) disposed between the high-pressure-stage impeller (5) and the electric motor (10). The bearing housing (16) has a first pressure-applying hole (95) having a third inner opening (951) formed in an inner surface (165) of the bearing housing (16) that faces an outer peripheral surface (181) of a rotating body (11) including the rotational shaft (3), and a third outer opening (932) formed in an outer surface (168) of the bearing housing (16), the third inner opening (951) being formed between the high-pressure-stage-side grease-filled bearing (15B) and the high-pressure-stage impeller (5) in an axial direction of the rotational shaft (3). The multi-stage electric centrifugal compressor (1) further comprises a pressure inlet line (26) configured to introduce pressure from a pressure source (e.g., compressed gas supply line 21 or surge tank 27) to the third outer opening (95).

With the above configuration 15), the bearing housing (16) has the first pressure-applying hole (95) having the third inner opening (951) formed in the inner surface (165), and the third outer opening (952) formed in the outer surface (168). The third inner opening (951) is formed between the high-pressure-stage-side grease-filled bearing (15B) and the high-pressure-stage impeller (5) in the axial direction of the rotational shaft (3). The multi-stage electric centrifugal compressor (1) includes the pressure inlet line (26). In this case, by introducing pressure from the pressure source to the third outer opening (95) through the pressure inlet line (26), the pressure in the gap (25) formed between the outer peripheral surface (181) and the (165) can be raised higher than the pressure in the space (24) facing the back surface (57) of the high-pressure-stage impeller (5). When the pressure in the gap (25) is higher than the pressure in the space (24), it is possible to prevent pressure leakage from the space (24) facing the back surface (57) of the high-pressure-stage impeller (5). This suppresses heat-induced deterioration of the high-pressure-stage-side grease-filled bearing (15B), thereby improving the life and durability of the high-pressure-stage-side grease-filled bearing (15B).

Further, when the pressure in the gap (25) is higher than the pressure in the space accommodating the high-pressure-stage-side grease-filled bearing (15B), grease filled in the high-pressure-stage-side grease-filled bearing (15B) is prevented from leaking through the gap (25) and the space (24) into the flow path through which the compressed gas flows. This prevents grease from mixing with the compressed gas compressed by the multi-stage electric centrifugal compressor (1), so that the multi-stage electric centrifugal compressor (1) can supply clean compressed gas to the fuel cell (20) or the like.

16) In some embodiments, the multi-stage electric centrifugal compressor (1) described in any one of the above 1) to 12) comprises: at least one bearing (15) rotatably supporting the rotational shaft (3) and disposed between the high-pressure-stage impeller (5) and the low-pressure-stage impeller (4); a bearing housing (16) accommodating the at least one bearing (15); and a stator housing (17) having an inner surface (171) that forms a motor accommodating portion (170) accommodating the electric motor (10), the stator housing (17) being disposed adjacent to the bearing housing (16). The bearing housing (16) has: an air inlet hole (30) having a fourth inner opening (34) formed in an inner surface (30) of the bearing housing (16) that faces the motor accommodating portion (170) and a fourth outer opening (35) formed in an outer surface (168) of the bearing housing (16), the fourth inner opening (34) being formed on one side of the electric motor (10) in an axial direction of the rotational shaft (3); and an air exhaust hole (31) having a fifth inner opening (37) formed in an inner surface (34) of the bearing housing (16) that faces the motor accommodating portion (170) and a fifth outer opening (38) formed in an outer surface (169) of the bearing housing (16), the fifth inner opening (37) being formed on the other side of the electric motor (10) in the axial direction of the rotational shaft (3). The multi-stage electric centrifugal compressor (1) further comprises an air inlet line (32) configured to supply air to the air inlet hole (30) or to suck air from the air exhaust hole (31).

With the above configuration 16), the air is forcibly introduced from the fourth outer opening (35) through the air inlet hole (30) to the motor accommodating portion (170) by the air inlet line (32). Further, the air is forcibly discharged from the motor accommodating portion (170) through the air exhaust hole (31) to the outside of the bearing housing (16) by the air inlet line (32). The fifth inner opening (37) of the air exhaust hole (31) is located on the opposite side of the electric motor (10) from the fourth inner opening (34) of the air inlet hole (30) in the axial direction of the rotational shaft (3). Thus, the air can be forcibly blown from one side to the other side of the motor accommodating portion (170). The electric motor (10) accommodated in the motor accommodating portion (170) is cooled (air-cooled) by dissipating heat through heat exchange with air. By cooling the rotor assembly (13) and a motor coil (121) of the electric motor (10), which is the heat source, with the air, the temperature rise of the bearing (15, high-pressure-stage-side grease-filled bearing 15B) can be suppressed. This suppresses heat-induced deterioration of the bearing (15), thereby improving the life and durability of the bearing (15).

REFERENCE SIGNS LIST

1 Multi-stage electric centrifugal compressor
3 Rotational shaft
4 Low-pressure-stage impeller
41 Hub
42 Outer peripheral surface
43 Impeller blade
44 Tip
5 High-pressure-stage impeller
51 Hub
52 Outer peripheral surface
53 Impeller blade
54 Tip
6 Low-pressure-stage housing
61 Low-pressure-stage inlet opening
62 Low-pressure-stage outlet opening
63 Supply passage
64 Scroll passage
65 Shroud
66 Low-pressure-stage impeller chamber
7 High-pressure-stage housing
70 High-pressure-stage-side cooling passage
71 High-pressure-stage inlet opening
72 High-pressure-stage outlet opening
73 Supply passage
74 Scroll passage
75 Shroud
76 High-pressure-stage impeller chamber
8 Connecting pipe
81 High-pressure-stage-side connection portion
82 Low-pressure-stage-side connection portion
83 Intermediate portion
84 Low-pressure-stage-side curved portion
85 High-pressure-stage-side curved portion
86 Cooling device
10 Electric motor
11 Rotating body
12 Motor stator
13 Rotor assembly
14 Permanent magnet
15 Bearing
15A Low-pressure-stage-side grease-filled bearing
15B High-pressure-stage-side grease-filled bearing
16 Bearing housing
16A Low-pressure-stage-side bearing housing
16B High-pressure-stage-side bearing housing
161, 162 Bearing support surface
163, 165 Inner surface
164, 166 Engagement surface
17 Stator housing
18A Low-pressure-stage-side sleeve
18B High-pressure-stage-side sleeve
19 Pressurizing spring
20 Fuel cell
201 Cathode
202 Anode

203 Solid electrolyte
21 Compressed gas supply line
22 First seal member
23 Second seal member
24 Space
25 Gap
26, 29 Pressure inlet line
27 Surge tank
28 Compressor
CA Axis (of rotational shaft)
CB Axis (of high-pressure-stage-side connection portion)
X Axial direction
XH High-pressure stage side (in axial direction)
XL Low-pressure stage side (in axial direction)
Y Radial direction

The invention claimed is:

1. A multi-stage electric centrifugal compressor, comprising:
a rotational shaft;
a low-pressure-stage impeller disposed at one end of the rotational shaft;
a high-pressure-stage impeller disposed at another end of the rotational shaft;
a high-pressure-stage housing accommodating the high-pressure-stage impeller;
an electric motor configured to drive the low-pressure-stage impeller and the high-pressure-stage impeller; and
a connecting pipe for supplying a compressed gas compressed by the low-pressure-stage impeller to the high-pressure-stage housing,
wherein the high-pressure-stage housing has a high-pressure-stage inlet opening that opens in a first direction intersecting an axis of the rotational shaft,
wherein the connecting pipe includes a high-pressure-stage-side connection portion connected to the high-pressure-stage inlet opening, and
wherein a flow path cross-section perpendicular to an extending direction of an axis of the high-pressure-stage-side connection portion has a longitudinal direction along a direction perpendicular to the axis of the rotational shaft, and includes concavely curved portions formed at both ends in the longitudinal direction of the flow path cross-section of the high-pressure-stage-side connection portion.

2. The multi-stage electric centrifugal compressor according to claim 1,
wherein the flow path cross-section of the high-pressure-stage-side connection portion has a transverse direction parallel to the axis of the rotational shaft.

3. The multi-stage electric centrifugal compressor according to claim 1,
wherein the flow path cross-section of the high-pressure-stage-side connection portion is formed such that a length in the longitudinal direction increases toward the high-pressure-stage inlet opening.

4. The multi-stage electric centrifugal compressor according to claim 3,
wherein the flow path cross-section of the high-pressure-stage-side connection portion is formed such that a curvature of the concavely curved portions increases toward the high-pressure-stage inlet opening.

5. The multi-stage electric centrifugal compressor according to claim 1, comprising
a low-pressure-stage housing accommodating the low-pressure-stage impeller,
wherein the low-pressure-stage housing has a low-pressure-stage outlet opening that opens in the first direction intersecting the axis of the rotational shaft,
wherein the connecting pipe includes:
a low-pressure-stage-side connection portion connected to the low-pressure-stage outlet opening;
an intermediate portion extending along the axis of the rotational shaft;
a low-pressure-stage-side curved portion having a curved shape that connects the low-pressure-stage-side connection portion and the intermediate portion; and
a high-pressure-stage-side curved portion having a curved shape that connects the high-pressure-stage-side connection portion and the intermediate portion, and
wherein at least a flow path cross-section of the low-pressure-stage-side connection portion is formed in a circular shape.

6. The multi-stage electric centrifugal compressor according to claim 1, further comprising a cooling device configured to perform heat exchange between the compressed gas in the connecting pipe and a cooling liquid for cooling the compressed gas.

7. The multi-stage electric centrifugal compressor according to claim 1,
wherein the high-pressure-stage housing includes:
an inner wall surface that defines a supply passage for leading the compressed gas supplied from the high-pressure-stage inlet opening to the high-pressure-stage impeller, the inner wall surface including an inner end wall surface that defines a side of the supply passage opposite to the high-pressure-stage impeller and an inner peripheral wall surface that defines an outer peripheral side of the supply passage; and
a guide protruding portion that protrudes from the inner end wall surface toward the high-pressure-stage impeller.

8. The multi-stage electric centrifugal compressor according to claim 7,
wherein the inner peripheral wall surface has an inlet-side inner peripheral wall surface formed with the high-pressure-stage inlet opening, and an opposite-side inner peripheral wall surface disposed opposite to the high-pressure-stage inlet opening, and
wherein the high-pressure-stage housing includes an anti-swirl plate that protrudes from the opposite-side inner peripheral wall surface.

9. The multi-stage electric centrifugal compressor according to claim 8,
wherein a tip of the anti-swirl plate is located on-radially further away from the rotational shaft than a tip end of a leading edge of the high-pressure-stage impeller.

10. The multi-stage electric centrifugal compressor according to claim 1, comprising:
at least one bearing rotatably supporting the rotational shaft and disposed between the high-pressure-stage impeller and the low-pressure-stage impeller; and
a bearing housing accommodating the at least one bearing,
wherein the at least one bearing includes a high-pressure-stage-side grease-filled bearing disposed between the high-pressure-stage impeller and the electric motor, and
wherein the bearing housing has a cooling passage formed between the high-pressure-stage-side grease-filled bearing and the high-pressure-stage impeller in an axial direction of the rotational shaft.

11. The multi-stage electric centrifugal compressor according to claim 1, wherein the high-pressure-stage housing has a high-pressure-stage-side cooling passage formed on an outer peripheral side of the rotational shaft, the high-pressure-stage-side cooling passage extending further radially out than the high-pressure-stage impeller.

12. The multi-stage electric centrifugal compressor according to claim 1, comprising:

at least one bearing rotatably supporting the rotational shaft and disposed between the high-pressure-stage impeller and the low-pressure-stage impeller; and a bearing housing accommodating the at least one bearing, wherein the at least one bearing includes a high-pressure-stage-side grease-filled bearing disposed between the high-pressure-stage impeller and the electric motor, and wherein the bearing housing has a first pressure-relieving hole having a first inner opening formed in an inner surface of the bearing housing that faces an outer peripheral surface of a rotating body including the rotational shaft, and a first outer opening formed in an outer surface of the bearing housing, the first inner opening being formed between the high-pressure-stage-side grease-filled bearing and the high-pressure-stage impeller in an axial direction of the rotational shaft.

13. The multi-stage electric centrifugal compressor according to claim 12, wherein the at least one bearing further includes a low-pressure-stage-side grease-filled bearing disposed between the low-pressure-stage impeller and the electric motor, and wherein the bearing housing has a second pressure-relieving hole having a second inner opening formed in the inner surface of the bearing housing that faces the outer peripheral surface of the rotating body including the rotational shaft, and a second outer opening formed in the outer surface of the bearing housing, the second inner opening being formed between the low-pressure-stage-side grease-filled bearing and the low-pressure-stage impeller in the axial direction of the rotational shaft.

14. The multi-stage electric centrifugal compressor according to claim 1, comprising:

at least one bearing rotatably supporting the rotational shaft and disposed between the high-pressure-stage impeller and the low-pressure-stage impeller; and a bearing housing accommodating the at least one bearing, wherein the at least one bearing includes a high-pressure-stage-side grease-filled bearing disposed between the high-pressure-stage impeller and the electric motor, wherein the bearing housing has a first pressure-applying hole having a third inner opening formed in an inner surface of the bearing housing that faces an outer peripheral surface of a rotating body including the rotational shaft, and a third outer opening formed in an outer surface of the bearing housing, the third inner opening being formed between the high-pressure-stage-side grease-filled bearing and the high-pressure-stage impeller in an axial direction of the rotational shaft, and wherein the multi-stage electric centrifugal compressor further comprises a pressure inlet line configured to introduce pressure from a pressure source to the third outer opening.

15. The multi-stage electric centrifugal compressor according to claim 1, comprising:

at least one bearing rotatably supporting the rotational shaft and disposed between the high-pressure-stage impeller and the low-pressure-stage impeller;

a bearing housing accommodating the at least one bearing; and a stator housing having an inner surface that forms a motor accommodating portion accommodating the electric motor, the stator housing being disposed adjacent to the bearing housing, wherein the bearing housing has:

an air inlet hole having a fourth inner opening formed in an inner surface of the bearing housing that faces the motor accommodating portion and a fourth outer opening formed in an outer surface of the bearing housing, the fourth inner opening being formed on one side of the electric motor in an axial direction of the rotational shaft; and an air exhaust hole having a fifth inner opening formed in the inner surface of the bearing housing that faces the motor accommodating portion and a fifth outer opening formed in the outer surface of the bearing housing, the fifth inner opening being formed on an other side of the electric motor in the axial direction of the rotational shaft, and wherein the multi-stage electric centrifugal compressor further comprises an air inlet line configured to supply air to the air inlet hole or to suck air from the air exhaust hole.

* * * * *